US009024714B2

(12) United States Patent
Matsuda et al.

(10) Patent No.: US 9,024,714 B2
(45) Date of Patent: May 5, 2015

(54) STATIC APPARATUS

(75) Inventors: Tetsuya Matsuda, Chiyoda-ku (JP); Ryuichi Nishiura, Chiyoda-ku (JP); Hiroyuki Akita, Chiyoda-ku (JP); Takeshi Imura, Chiyoda-ku (JP); Yasuo Fujiwara, Chiyoda-ku (JP); Yoshinori Shimizu, Chiyoda-ku (JP); Kazuaki Aono, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 288 days.

(21) Appl. No.: 13/575,134

(22) PCT Filed: Oct. 22, 2010

(86) PCT No.: PCT/JP2010/068667
§ 371 (c)(1),
(2), (4) Date: Jul. 25, 2012

(87) PCT Pub. No.: WO2011/111257
PCT Pub. Date: Sep. 15, 2011

(65) Prior Publication Data

US 2012/0299686 A1 Nov. 29, 2012

(30) Foreign Application Priority Data

Mar. 9, 2010 (JP) ..... PCT/JP2010/053837

(51) Int. Cl.
*H01F 27/24* (2006.01)
*H01F 21/06* (2006.01)
(Continued)

(52) U.S. Cl.
CPC ..... *H01F 27/245* (2013.01); *H01F 27/34* (2013.01)

(58) Field of Classification Search
USPC ..... 336/212, 134, 165, 178
See application file for complete search history.

(56) References Cited

U.S. PATENT DOCUMENTS 2,749,746 A * 6/1956 Wright ..... 73/779
2,892,169 A * 6/1959 Teague et al. ..... 336/213
(Continued)

FOREIGN PATENT DOCUMENTS

CN 2347248 (Y) 11/1999
CN 2529361 (Y) 1/2003
(Continued)

OTHER PUBLICATIONS

Japanese Decision to Grant Patent Issued Jun. 18, 2013 in Patent Application No. 2012-504274 (with English translation).
(Continued)

*Primary Examiner* — Elvin G Enad
*Assistant Examiner* — Ronald Hinson
(74) *Attorney, Agent, or Firm* — Oblon, McClelland, Maier & Neustadt, L.L.P.

(57) ABSTRACT

A static apparatus includes an iron core which includes a plurality of magnetic plates stacked in one direction and in which a shaft portion having a main surface and a side surface is formed, and a coil wound around the shaft portion. Slits extending in an axial direction of the shaft portion are formed in at least a surface layer magnetic plate constituting the main surface, of the plurality of magnetic plates. Some of the slits are formed in the main surface, at an end portion close to the side surface, at a predetermined formation density. The formation density of the slits is highest at the predetermined formation density, and is reduced as at least one of a minimum distance from the side surface within the main surface and a distance from the main surface on a side close to the slits in the stacking direction is increased.

1 Claim, 32 Drawing Sheets

REFERENCE EXAMPLE 1

(51) Int. Cl.

| | |
|---|---|
| ***H01F 21/08*** | (2006.01) |
| ***H01F 27/28*** | (2006.01) |
| ***H01F 27/245*** | (2006.01) |
| ***H01F 27/34*** | (2006.01) |

(56) References Cited

U.S. PATENT DOCUMENTS

| | | | | |
|---|---|---|---|---|
| 3,290,633 | A * | 12/1966 | Kuriyama et al. | 336/60 |
| 4,520,556 | A * | 6/1985 | Pasko et al. | 29/606 |
| 5,815,062 | A * | 9/1998 | Koyuhara et al. | 336/233 |
| 2012/0056706 | A1* | 3/2012 | Schafer et al. | 336/212 |

FOREIGN PATENT DOCUMENTS

| | | | |
|---|---|---|---|
| JP | 46-61620 | A | 6/1974 |
| JP | 49-61620 | A | 6/1974 |
| JP | 51 17527 | | 2/1976 |
| JP | 55 22135 | | 2/1980 |
| JP | 58 193620 | | 12/1983 |
| JP | 63-20810 | A | 1/1988 |
| JP | 63 20811 | | 1/1988 |
| JP | 3 147307 | | 6/1991 |
| JP | 2003 347134 | | 12/2003 |
| JP | 2006-351920 | A | 12/2006 |
| JP | 2009 182115 | | 8/2009 |

OTHER PUBLICATIONS

International Search Report Issued Dec. 21, 2010 in PCT/JP10/68667 Filed Oct. 22, 2010.

Combined Office Action and Search Report issued Aug. 12, 2014 in Chinese Patent Application No. 201080064857.X (with English translation and English translation of category of cited documents).

* cited by examiner

REFERENCE EXAMPLE 1

REFERENCE EXAMPLE 1

REFERENCE EXAMPLE 1

REFERENCE EXAMPLE 1

REFERENCE EXAMPLE 1

REFERENCE EXAMPLE 2

REFERENCE EXAMPLE 2

REFERENCE EXAMPLE 2

REFERENCE EXAMPLE 2

REFERENCE EXAMPLE 2

REFERENCE EXAMPLE 2

REFERENCE EXAMPLE 2

REFERENCE EXAMPLE 2

REFERENCE EXAMPLE 2

STATIC APPARATUS

TECHNICAL FIELD

The present invention relates to a static apparatus, and in particular to a structure of an iron core of a static apparatus.

BACKGROUND ART

Reduction of loss in a static apparatus is required to improve efficiency of the static apparatus. The loss in the static apparatus includes eddy current loss due to a leakage magnetic flux from a coil. Examples of prior literature disclosing a technique for reducing eddy current loss include Japanese Patent Laying-Open No. 2003-347134 (PTL 1) and Japanese Utility Model Laying-Open No. 55-22135 (PTL 2).

In a three-phase reactor described in PTL 1, a slit in a horizontal direction is formed in both of upper and lower ring yokes sandwiching a stacked block iron core. In a transformer described in PTL 2, it is disclosed that an electromagnetic shield is arranged between a coil and an iron core of a shell-type transformer. Since this allows a leakage magnetic field from the coil to pass through only within the electromagnetic shield, the leakage magnetic field from the coil is not applied to the iron core, and no eddy current loss is generated. Since the stacking direction of the electromagnetic shield is different from the stacking direction of the iron core by 90°, the electromagnetic shield has little eddy current loss due to the leakage magnetic field from the coil.

CITATION LIST

Patent Literature

PTL 1: Japanese Patent Laying-Open No. 2003-347134

PTL 2: Japanese Utility Model Laying-Open No. 55-22135

SUMMARY OF INVENTION

Technical Problem

As described above, various techniques for reducing eddy current loss in a static apparatus have been proposed. However, in order to improve efficiency of a static apparatus, it is required to reduce loss in the static apparatus as much as possible. Therefore, there is still room for improvement in the techniques for reducing loss in a static apparatus. Further, since an electromagnetic shield is expensive, it results in an increase in manufacturing cost of a static apparatus.

The present invention has been made in view of the aforementioned problems, and one object of the present invention is to provide an inexpensive static apparatus having a structure of an iron core capable of reducing loss in the static apparatus.

Solution to Problem

A static apparatus according to the present invention includes an iron core which includes a plurality of magnetic plates stacked in one direction and in which a shaft portion having a main surface and a side surface is formed, and a coil wound around the shaft portion. The main surface is opposed to an inner peripheral surface of the coil in a stacking direction of the plurality of magnetic plates. The side surface is opposed to the inner peripheral surface in a direction perpendicular to the stacking direction to connect the main surfaces.

Slits extending in an axial direction of the shaft portion are formed in at least a surface layer magnetic plate constituting the main surface, of the plurality of magnetic plates. Some of the slits are formed in the main surface, at an end portion close to the side surface, at a predetermined formation density. The formation density of the slits is highest at the predetermined formation density, and is reduced as at least one of a minimum distance from the side surface within the main surface and a distance from the main surface on a side close to the slits in the stacking direction is increased. Here, the formation density of the slits refers to the number of formed slits per unit area of a magnetic plate when seen in a plan view.

Advantageous Effects of Invention

According to the present invention, it is possible to reduce loss in a static apparatus by reducing eddy current loss in an iron core, while suppressing an increase in manufacturing cost of the static apparatus.

DESCRIPTION OF EMBODIMENTS

Figure 1:
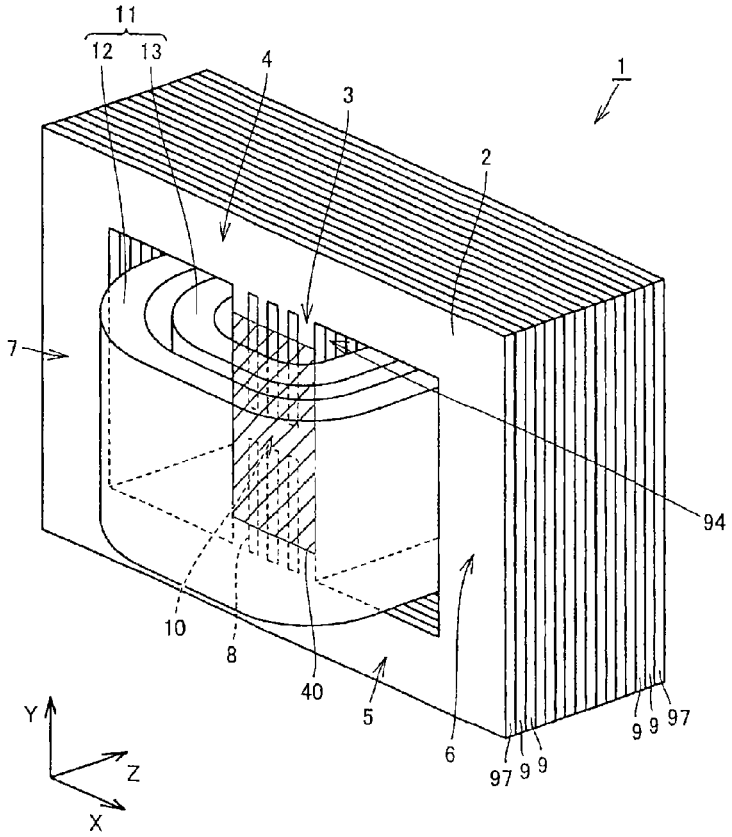
FIG. 1 is a perspective view schematically showing a configuration of a core-type transformer in accordance with Reference Example 1 of the present invention.

Since the present invention is applicable to a static apparatus such as a core-type transformer, a shell-type transformer, and a reactor, the following embodiments will describe any of a core-type transformer, a shell-type transformer, and a reactor as an example. It is to be noted that the terms "upper", "lower", "right", and "left", and names including these terms will be used as appropriate in the following description, these directions are used for easier understanding of the invention with reference to the drawings, and the form obtained by vertically flipping an embodiment or rotating an embodiment in an arbitrary direction is also naturally within the technical scope of the invention of the present application. Further, identical or corresponding parts in the drawings will be designated by the same reference numerals, and the description thereof will not be repeated.

Hereinafter, a core-type transformer in accordance with Reference Example 1 related to the present invention will be described with reference to the drawings.

REFERENCE EXAMPLE 1

FIG. 1 is a perspective view schematically showing a configuration of a core-type transformer in accordance with Reference Example 1 of the present invention. As shown in FIG. 1, a core-type transformer 1 in accordance with the present reference example includes an iron core 2 which includes a plurality of magnetic plates 9 stacked in a Z direction as one direction and in which a shaft portion 3 having a main surface 10 and a side surface 94 is formed, and a coil 11 wound around shaft portion 3.

Iron core 2 has a stacked structure in which a plurality of thin-plate magnetic bodies are stacked in layers. Magnetic plate 9 refers to a thin plate-like magnetic body. As magnetic plate 9, an electromagnetic steel plate, more specifically, a directional steel plate, is used. Iron core 2 includes an upper yoke 4, a lower yoke 5, and a right yoke 6 and a left yoke 7 which each connect upper yoke 4 and lower yoke 5. Shaft portion 3 connects upper yoke 4 and lower yoke 5, and is provided at a central position between right yoke 6 and left yoke 7. Coil 11 includes a high-voltage coil 12 and a low-voltage coil 13 coaxially arranged around shaft portion 3 as a common central axis.

The Z axis shown in FIG. 1 indicates a stacking direction of the plurality of magnetic plates 9. The Y axis indicates an axial direction of shaft portion 3, and is an axis perpendicular to the Z axis. The X axis is an axis perpendicular to the Y axis and the Z axis. Since the above relations are also satisfied among the X axis, the Y axis, and the Z axis in the drawings described below, the description about the X axis, the Y axis, and the Z axis will not be repeated hereinafter.

Main surface 10 is opposed to an inner peripheral surface of coil 11 in the stacking direction of the plurality of magnetic plates 9. There are two main surfaces 10 on the front and rear sides in a paper plane of FIG. 1. Side surface 94 is opposed to the inner peripheral surface of coil 11 in a direction perpendicular to the stacking direction to connect main surfaces 10. There are two side surfaces 94 on the right and left sides in the paper plane of FIG. 1.

In the present reference example, slits 8 are formed in a surface layer magnetic plate 97 constituting main surface 10, of the plurality of magnetic plates 9. It is to be noted that, although FIG. 1 shows core-type transformer 1 seen from one side along the stacking direction of the plurality of magnetic plates 9, core-type transformer 1 seen from the opposite side also has the same configuration as that in FIG. 1. Namely, slits 8 are formed in surface layer magnetic plates 97 at both ends of the plurality of magnetic plates 9 stacked along a Z axis direction.

In the present reference example, slits 8 extend in the axial direction of shaft portion 3. In other words, slits 8 have a longitudinal direction along a Y axis direction. Here, a region where coil 11 is projected onto surface layer magnetic plate 97 in the stacking direction of the plurality of magnetic plates 9 will be referred to as a projection region 40. Slits 8 are formed in a region including at least a portion of projection region 40.

Figure 2:
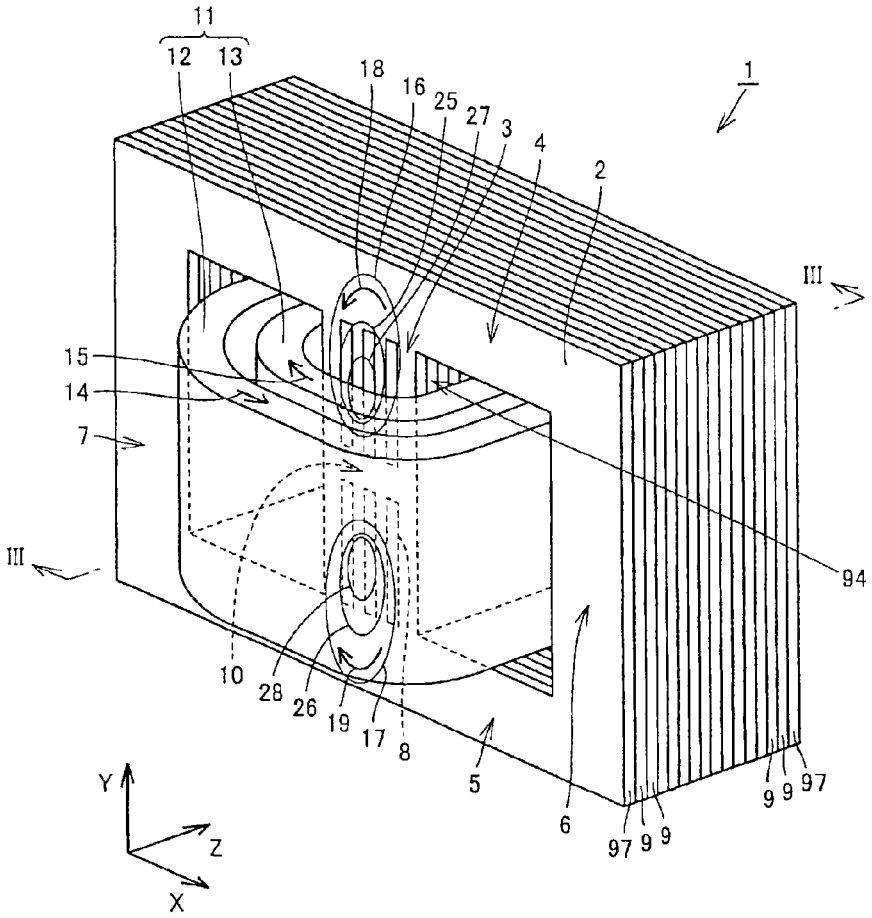
FIG. 2 is a perspective view schematically showing eddy currents generated in an iron core when a current is passed through a coil of the core-type transformer in accordance with the reference example.
Figure 3:
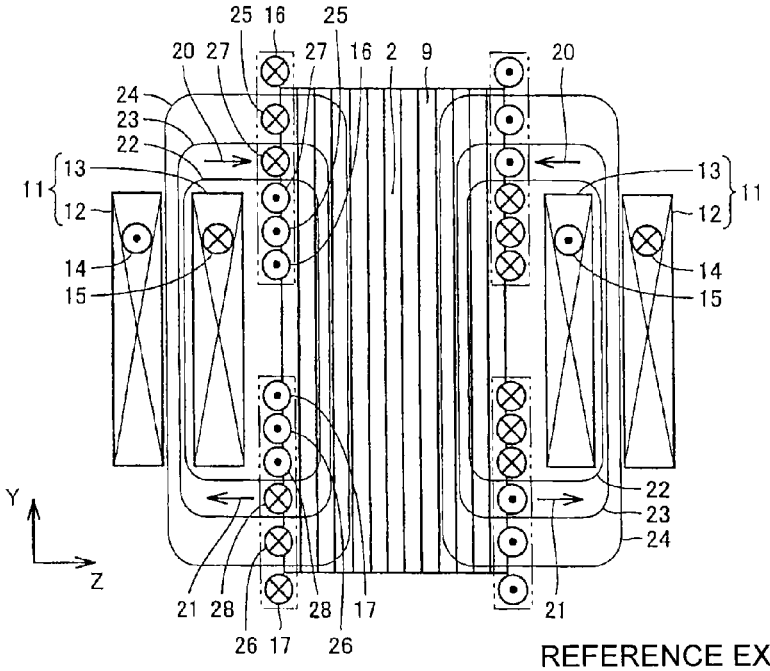
FIG. 3 is a view seen from the direction of arrows in a line III-III in FIG. 2.

FIG. 2 is a perspective view schematically showing eddy currents generated in the iron core when a current is passed through the coil of the core-type transformer in accordance with the present reference example. FIG. 3 is a view seen from the direction of arrows in a line III-III in FIG. 2.

As shown in FIGS. 2 and 3, a current is passed in a direction 15 in low-voltage coil 13. The current causes a main magnetic flux directed downward in a Y direction to appear in iron core 2, and thereby an induction current flowing in a direction 14 is generated in high-voltage coil 12. On this occasion, leakage magnetic fields 22, 23, 24 are generated around low-voltage coil 13. Leakage magnetic fields 22, 23, 24 serve as magnetic fields circulating around the outer periphery of low-voltage coil 13 and through shaft portion 3.

As shown in FIG. 3, on an upper end side of low-voltage coil 13, leakage magnetic fields 22, 23, 24 are generated in directions indicated by arrows 20. Thus, magnetic fluxes of leakage magnetic fields 22, 23, 24 enter magnetic plates 9 of iron core 2 in the direction perpendicular to magnetic plates 9. Since eddy currents generated by entry of the magnetic fluxes of leakage magnetic fields 22, 23, 24 are generated in a surface direction of magnetic plates 9, influence of eddy current loss is considerably exhibited.

An eddy current 27 generated by entry of the magnetic flux of leakage magnetic field 22 into magnetic plates 9 is generated in the vicinity of a position where an upper end of coil 11 is projected onto surface layer magnetic plate 97 in the stacking direction of the plurality of magnetic plates 9, so as to interlink with leakage magnetic field 22. An eddy current 25 generated by entry of the magnetic flux of leakage magnetic field 23 into magnetic plates 9 is generated outside eddy current 27, so as to interlink with leakage magnetic field 23. An eddy current 16 generated by entry of the magnetic flux of leakage magnetic field 24 into magnetic plates 9 is generated to flow through the vicinity of an upper end of iron core 2 outside eddy current 25, so as to interlink with leakage magnetic field 24. Eddy currents 27, 25, 16 flow in a direction indicated by an arrow 18.

Further, on a lower end side of low-voltage coil 13, leakage magnetic fields 22, 23, 24 are generated in directions indicated by arrows 21. Thus, the magnetic fluxes of leakage magnetic fields 22, 23, 24 exit from magnetic plates 9 of iron core 2 in the direction perpendicular to magnetic plates 9. Since eddy currents generated by exit of the magnetic fluxes of leakage magnetic fields 22, 23, 24 are generated in the surface direction of magnetic plates 9, influence of eddy current loss is considerably exhibited.

An eddy current 28 generated by exit of the magnetic flux of leakage magnetic field 22 from magnetic plates 9 is generated in the vicinity of a position where a lower end of coil 11 is projected onto surface layer magnetic plate 97 in the stacking direction of the plurality of magnetic plates 9, so as to interlink with leakage magnetic field 22. An eddy current 26 generated by exit of the magnetic flux of leakage magnetic field 23 from magnetic plates 9 is generated outside eddy current 28, so as to interlink with leakage magnetic field 23. An eddy current 17 generated by exit of the magnetic flux of leakage magnetic field 24 from magnetic plates 9 is generated to flow through the vicinity of a lower end of iron core 2 outside eddy current 26, so as to interlink with leakage magnetic field 24. Eddy currents 28, 26, 17 flow in a direction indicated by an arrow 19.

Figure 4:
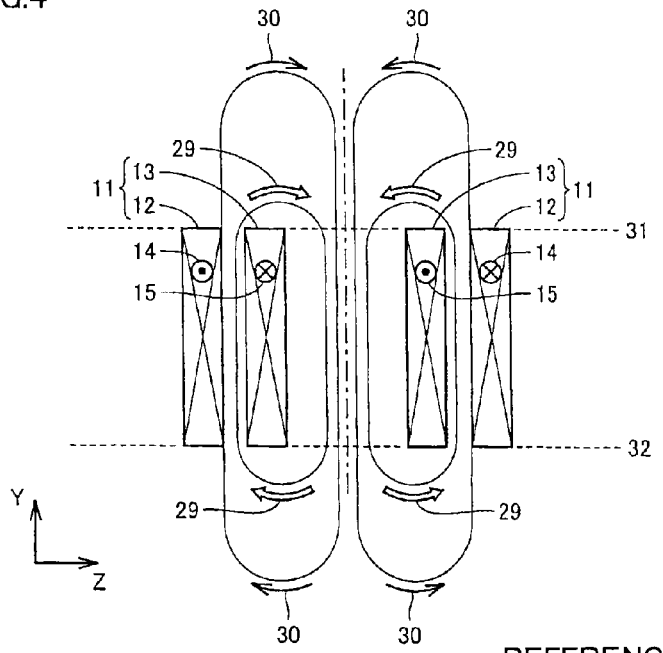
FIG. 4 is a view schematically showing leakage magnetic fields generated around the coil of the core-type transformer in accordance with the reference example.

FIG. 4 is a view schematically showing leakage magnetic fields generated around the coil of the core-type transformer in accordance with the present reference example. FIG. 4 does not show the iron core for simplicity, and only shows a magnetic field generated close to low-voltage coil 13 and a magnetic field generated far from low-voltage coil 13, as the leakage magnetic fields.

As shown in FIG. 4, the leakage magnetic field generated in the vicinity of end portions of low-voltage coil 13 has a magnetic flux density 29 higher than a magnetic flux density 30 of the leakage magnetic field generated at a position away from the end portions of low-voltage coil 13. The higher the density of a magnetic flux passing through magnetic plates 9 of iron core 2 is, the more an eddy current is generated. Thus, eddy currents are increased at the positions where the end portions of coil 11 are projected onto surface layer magnetic plate 97 in the stacking direction of magnetic plates 9.

A broken line 31 indicates an upper end position of coil 11, and a broken line 32 indicates a lower end position of coil 11. Accordingly, a range between broken line 31 and broken line 32 is a vertical range of projection region 40 shown in FIG. 1.

Figure 5:
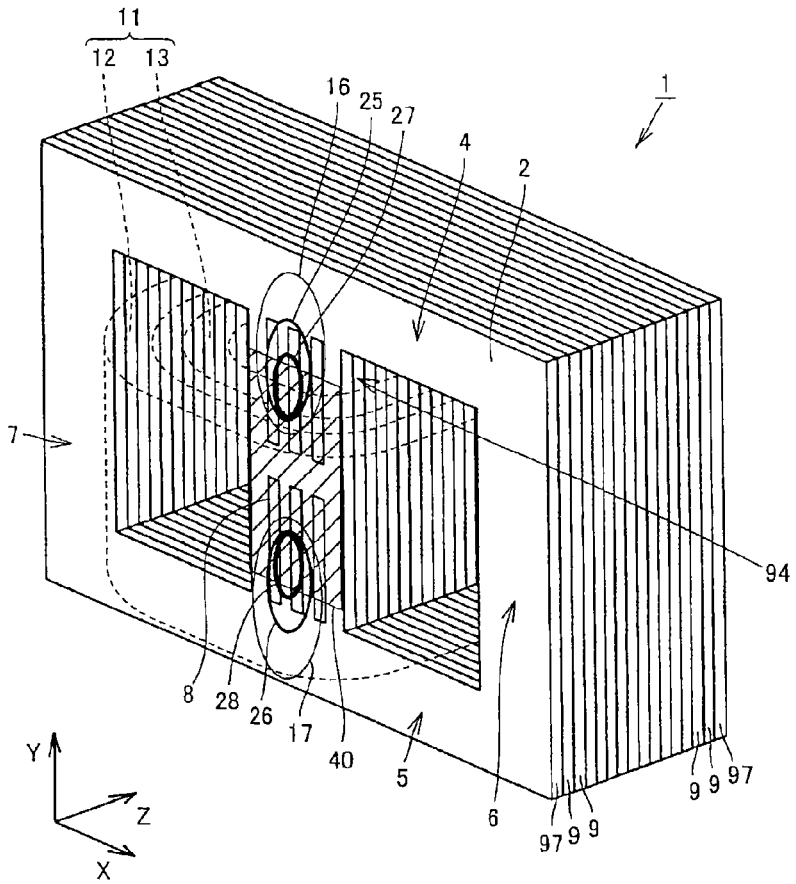
FIG. 5 is a perspective view schematically showing the eddy currents generated in the core-type transformer in accordance with the reference example.

FIG. 5 is a perspective view schematically showing the eddy currents generated in the core-type transformer in accordance with the present reference example. In FIG. 5, the amount of the flowing eddy current is indicated by the thickness of a line, and the eddy current indicated by a thicker line indicates that a larger current flows.

As shown in FIG. 5, more currents flow in eddy currents 27, 28 generated in the vicinity of the positions where the end portions of coil 11 are projected onto surface layer magnetic plate 97 in the stacking direction of the plurality of magnetic plates 9, when compared with eddy currents 25, 26 and eddy currents 16, 17 generated at positions away from those positions.

Therefore, in core-type transformer 1, eddy current loss can be efficiently reduced by forming slits 8 to cut eddy currents 27, 28 generated by intense leakage magnetic field 22. Thus, eddy current loss can be efficiently reduced by forming slits 8 at a position including at least a portion of projection region 40, which is the region where coil 11 is projected onto surface layer magnetic plate 97 in the stacking direction of magnetic plates 9.

In order to reduce the size of slits 8, slits 8 may be divided in the axial direction of shaft portion 3 as shown in FIG. 1. Thereby, eddy current loss can be efficiently reduced while reducing a range where slits 8 are formed. It is to be noted that slits 8 are provided to extend in the axial direction of shaft portion 3. If slits 8 are provided in an X direction, they are magnetoresistive to a main magnetic flux generated in shaft portion 3, and thus such a case is not preferable. Although slits 8 are formed in only surface layer magnetic plate 97 in the present reference example, slits 8 may be formed in predetermined magnetic plates 9 arranged consecutively in the stacking direction of magnetic plates 9.

Hereinafter, a shell-type transformer in accordance with Reference Example 2 related to the present invention will be described with reference to the drawings.

REFERENCE EXAMPLE 2

Figure 6:
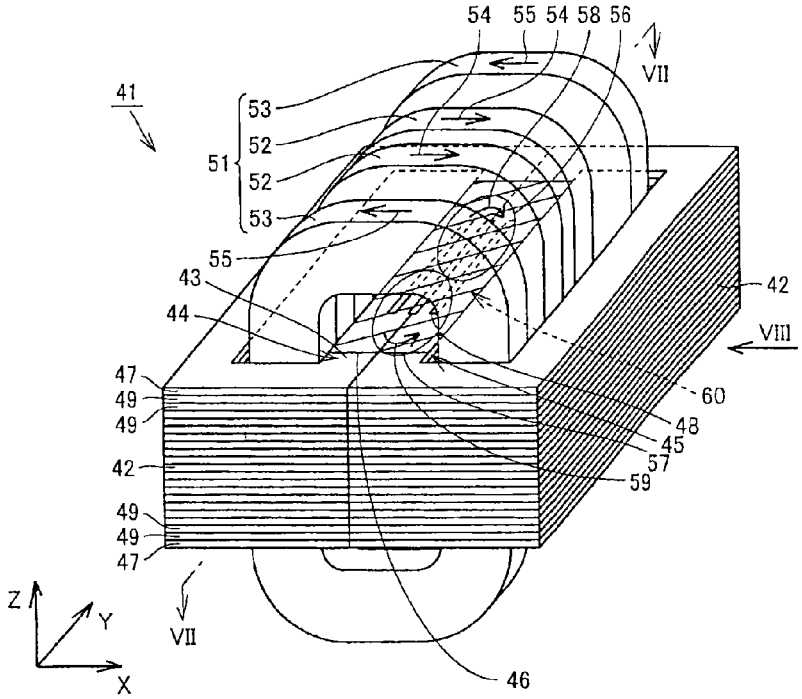
FIG. 6 is a perspective view schematically showing a configuration of a shell-type transformer in accordance with Reference Example 2 of the present invention.
Figure 7:
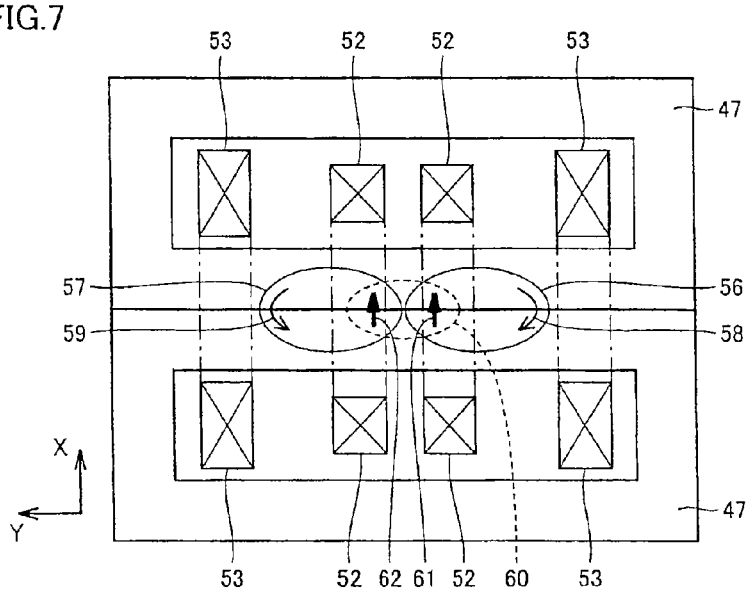
FIG. 7 is a cross sectional view seen from the direction of arrows in a line VII-VII in FIG. 6.
Figure 8:
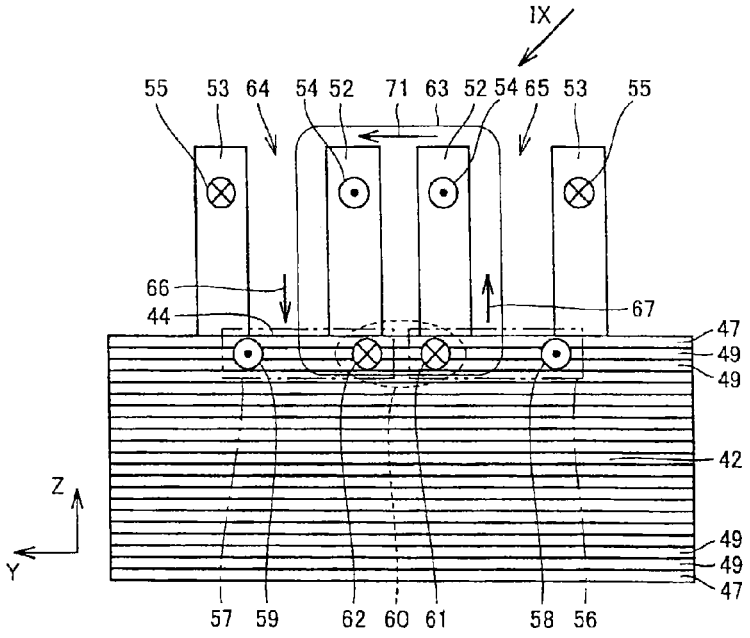
FIG. 8 is a view of the shell-type transformer in FIG. 6 seen from an arrow VIII.

FIG. 6 is a perspective view schematically showing a configuration of a shell-type transformer in accordance with Reference Example 2 of the present invention. FIG. 7 is a cross sectional view seen from the direction of arrows in a line VII-VII in FIG. 6. FIG. 8 is a view of the shell-type transformer in FIG. 6 seen from an arrow VIII. FIG. 7 does not show slits 48 for simplicity.

As shown in FIGS. 6 and 7, a shell-type transformer 41 in accordance with the present reference example includes two iron cores 42 and one coil 51. Each iron core 42 includes a plurality of magnetic plates 49 stacked in the Z direction as one direction, and has a frame-like shape. Iron core 42 has a stacked structure in which a plurality of thin-plate magnetic bodies are stacked in layers. Magnetic plate 49 refers to a thin plate-like magnetic body. As magnetic plate 49, an electromagnetic steel plate, more specifically, a directional steel plate, is used. Two iron cores 42 are arranged in parallel to form a shaft portion 43 having a main surface 44 and a side surface 45.

Coil 51 includes low-voltage coils 53 and high-voltage coils 52. In the present reference example, the coils are arranged in parallel in an axial direction of shaft portion 43, in the order of low-voltage coil 53, high-voltage coil 52, high-voltage coil 52, and low-voltage coil 53 from the front side of FIG. 6. Coil 51 is wound around shaft portion 43.

By arranging the coils so as to sandwich high-voltage coils 52, to which a high voltage is applied, between low-voltage coils 53, to which a low voltage is applied, as described above, a distance between high-voltage coil 52 and iron core 42 in the axial direction of shaft portion 43 is increased to ensure an insulation distance. Further, by decreasing the width of high-voltage coil 52 in the X direction to be smaller than the width of low-voltage coil 53, a distance between high-voltage coil 52 and iron core 42 in the X direction is increased to ensure an insulation distance.

Main surface 44 is opposed to an inner peripheral surface of coil 51 in a stacking direction of the plurality of magnetic plates 49. There are two main surfaces 44 on the upper and lower sides of iron core 42. Side surface 45 is opposed to the inner peripheral surface of coil 51 in a direction perpendicular to the stacking direction to connect main surfaces 44. There are two side surfaces 45 on the right and left sides of shaft portion 43.

In the present reference example, slits 48 are formed in a surface layer magnetic plate 47 constituting main surface 44, of the plurality of magnetic plates 49. It is to be noted that, although FIG. 6 shows shell-type transformer 41 seen from one side of the plurality of magnetic plates 49, shell-type transformer 41 seen from the opposite side also has the same configuration as that in FIG. 6. Namely, slits 48 are formed in surface layer magnetic plates 47 at both ends of the plurality of magnetic plates 49 stacked along the Z axis direction.

In the present reference example, slits 48 extend in the axial direction of shaft portion 43. In other words, slits 48 have a longitudinal direction along the Y axis direction. Here, a region where coil 51 is projected onto surface layer magnetic plate 47 in the stacking direction of the plurality of magnetic plates 49 will be referred to as a projection region 46. Slits 48 are formed in a region including at least a portion of projection region 46.

As shown in FIGS. 6 to 8, a current is passed in a direction indicated by an arrow 54 in each high-voltage coil 52. The current causes a main magnetic flux in the Y direction to appear in iron core 42, and thereby an induction current in a direction indicated by an arrow 55 is generated in each low-voltage coil 53. Due to these currents, a leakage magnetic field 63 is generated around high-voltage coils 52. Leakage magnetic field 63 serves as a magnetic field circulating around the outer periphery of high-voltage coils 52 and through shaft portion 43.

As shown in FIG. 8, in a region 64 between low-voltage coil 53 and high-voltage coil 52, leakage magnetic field 63 is generated in a direction indicated by an arrow 66. Thus, a magnetic flux of leakage magnetic field 63 enters surface layer magnetic plate 47 of iron core 42 in a direction perpendicular to surface layer magnetic plate 47. Since an eddy current generated by entry of the magnetic flux of leakage magnetic field 63 is generated in a surface direction of surface layer magnetic plate 47, influence of eddy current loss is considerably exhibited.

An eddy current 57 generated by entry of the magnetic flux of leakage magnetic field 63 into surface layer magnetic plate 47 is generated in the vicinity of region 64 described above in surface layer magnetic plate 47, so as to interlink with leakage magnetic field 63. Eddy current 57 flows in a direction indicated by an arrow 59.

Further, in a region 65 between low-voltage coil 53 and high-voltage coil 52, leakage magnetic field 63 is generated in a direction indicated by an arrow 67. Thus, the magnetic flux of leakage magnetic field 63 exits from surface layer magnetic plates 47 of iron core 42 in the direction perpendicular to surface layer magnetic plates 47. Since an eddy current generated by exit of the magnetic flux of leakage magnetic field 63 is generated in the surface direction of surface layer magnetic plate 47, influence of eddy current loss is considerably exhibited.

An eddy current 56 generated by exit of the magnetic flux of leakage magnetic field 63 from surface layer magnetic plate 47 is generated in the vicinity of region 65 described above in surface layer magnetic plate 47, so as to interlink with leakage magnetic field 63. Eddy current 56 flows in a direction indicated by an arrow 58. As shown in FIGS. 6 and 7, eddy current 56 and eddy current 57 flow in the same direction in a close region 60 at a position between two high-voltage coils 52.

Close region 60 includes a region where an interval between adjacent high-voltage coils 52 is projected onto surface layer magnetic plate 47 in the stacking direction of magnetic plates 49. In close region 60, eddy current 57 flows in a direction indicated by an arrow 62, and eddy current 56 flows in a direction indicated by an arrow 61.

Figure 9:
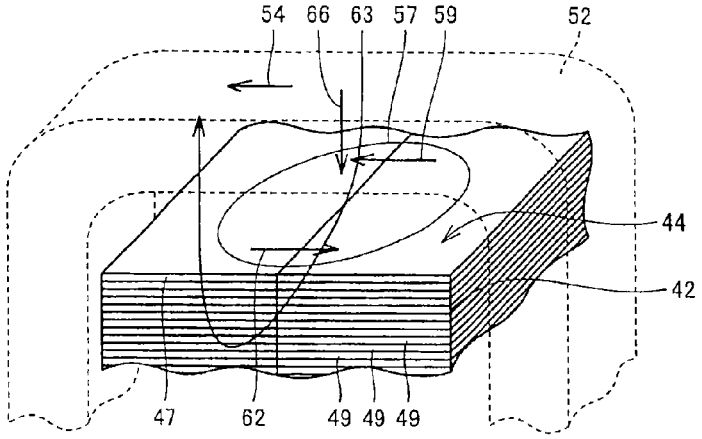
FIG. 9 is a perspective view of the shell-type transformer in FIG. 8 seen from a IX direction.

FIG. 9 is a perspective view of the shell-type transformer in FIG. 8 seen from a IX direction. FIG. 9 only shows one high-voltage coil 52 and a portion of iron core 42 for simplicity. As shown in FIG. 9, leakage magnetic field 63 is generated by passing a current in the direction indicated by arrow 54 in high-voltage coil 52. The magnetic flux of leakage magnetic field 63 enters surface layer magnetic plate 47 in the direction indicated by arrow 66. Thus, in surface layer magnetic plate 47, eddy current 57 is generated in directions of arrows 59, 62 to cancel the magnetic flux of leakage magnetic field 63.

Since eddy current loss is generated due to heat generation by eddy current 57, an electromagnetic shield has been conventionally provided between an inner peripheral surface of high-voltage coil 52 and main surface 44 of iron core 42. Generation of eddy current loss has been prevented by providing an electromagnetic shield to avoid the magnetic flux of leakage magnetic field 63 from entering surface layer magnetic plate 47. Since the electromagnetic shield is expensive, if generation of eddy current loss can be suppressed without providing an electromagnetic shield, manufacturing cost of a transformer can be reduced.

Although the present reference example aims at reducing eddy current loss without providing an electromagnetic shield, by providing slits 48 in surface layer magnetic plate 47, processing cost for providing slits 48 can be reduced by reducing the size of slits 48. Thus, it is necessary to provide small slits 48 at a position where eddy current loss can be effectively reduced.

Figure 10:
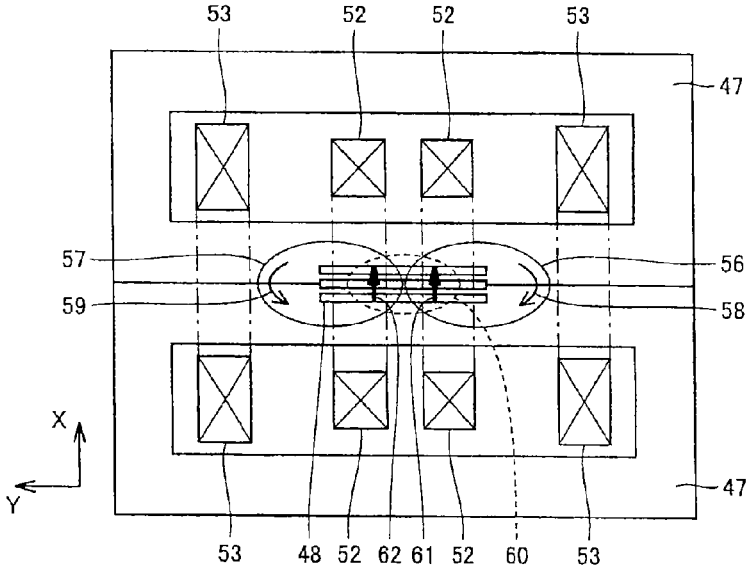
FIG. 10 is a cross sectional view identical to FIG. 7, showing slits.

FIG. 10 is a cross sectional view identical to FIG. 7, showing slits. As described above, in close region 60, eddy current 56 and eddy current 57 flow in the same direction. Thus, if the amount of eddy current 56 or the amount of eddy current 57 in another region is set as I, an eddy current in an amount 21, which is substantially double, flows in close region 60. Since heat generation loss due to an eddy current is represented by $4\times R\times I^2$, heat generation loss almost four times larger than that due to eddy current 56, 57 in the other region is generated in close region 60.

By providing slits 48 in close region 60 as shown in FIG. 10, eddy current 56 and eddy current 57 can be cut. As a result, eddy current loss, which is heat generation loss due to eddy current 56 and eddy current 57, can be effectively reduced. Eddy current loss can be reduced by providing slits 48 at an effective position, and manufacturing cost can be reduced by reducing the size of slits 48.

In the present reference example, shell-type transformer 41 in which the coils are arranged in parallel in the axial direction of shaft portion 43, in the order of the low-voltage coil, the high-voltage coil, the high-voltage coil, and the low-voltage coil, is used. As a modification, a description will be given of a position for forming slits in a shell-type transformer in which four low-voltage coils and four high-voltage coils are arranged in parallel in the axial direction of shaft portion 43, in the order of a low-voltage coil, a high-voltage coil, a high-voltage coil, a low-voltage coil, a low-voltage coil, a high-voltage coil, a high-voltage coil, and a low-voltage coil.

Figure 11:
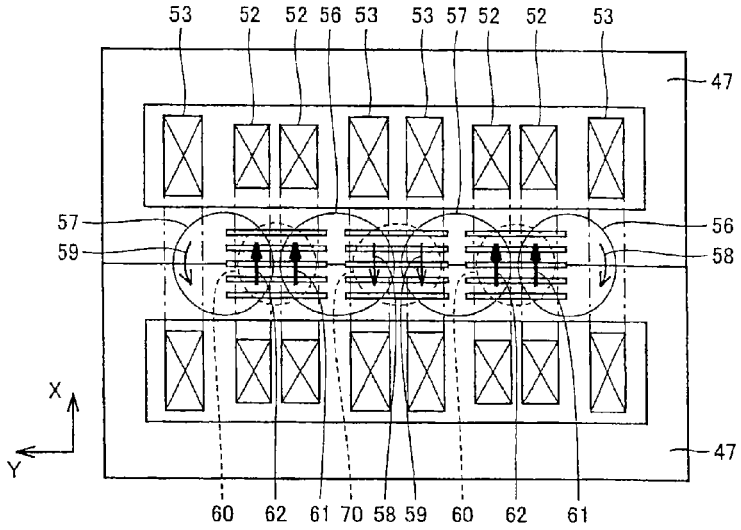
FIG. 11 is a cross sectional view of a shell-type transformer in a modification, corresponding to FIG. 10.
Figure 12:
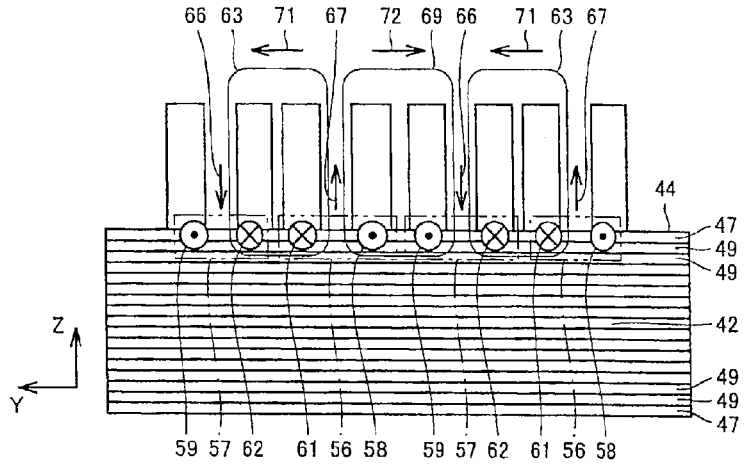
FIG. 12 is a side view of the shell-type transformer in the modification, corresponding to FIG. 8.

FIG. 11 is a cross sectional view of the shell-type transformer in the modification, corresponding to FIG. 10. FIG. 12 is a side view of the shell-type transformer in the modification, corresponding to FIG. 8. As shown in FIGS. 11 and 12, in the shell-type transformer in the modification, leakage magnetic fields 63 each circulating around high-voltage coils 52 and through a shaft portion, and a leakage magnetic field 69 circulating around low-voltage coils 53 and through the shaft portion are generated.

Due to leakage magnetic fields 63 and leakage magnetic field 69, eddy currents 56 and eddy currents 57 are generated in surface layer magnetic plate 47. Eddy current 56 flows in the direction indicated by arrow 58. Eddy current 57 flows in the direction indicated by arrow 59. Eddy current 56 and eddy current 57 flow in the same direction in each close region 60 at a position between two adjacent high-voltage coils 52. Further, eddy current 56 and eddy current 57 flow in the same direction in a close region 70 at a position between two adjacent low-voltage coils 53.

Close region 70 includes a region where an interval between adjacent low-voltage coils 53 is projected onto surface layer magnetic plate 47 in the stacking direction of magnetic plates 49. In close region 70, eddy current 57 flows in the direction indicated by arrow 59, and eddy current 56 flows in the direction indicated by arrow 58.

Therefore, in the shell-type transformer in the modification, slits are provided in close regions 60 and close region 70 in a manner divided into three in the axial direction of the shaft portion. Thereby, eddy currents 56 and eddy currents 57 can be cut. As a result, eddy current loss, which is heat generation loss due to eddy currents 56 and eddy currents 57, can be effectively reduced. Eddy current loss can be reduced by providing the slits at effective positions, and manufacturing cost can be reduced by reducing the size of the slits.

Figure 13:
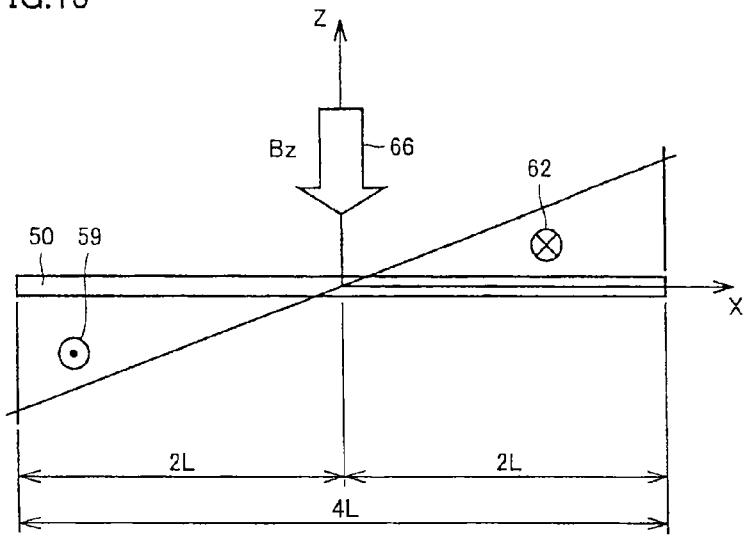
FIG. 13 is a view schematically showing an eddy current generated when a magnetic field in a vertical direction is uniformly applied to a magnetic plate.
Figure 14:
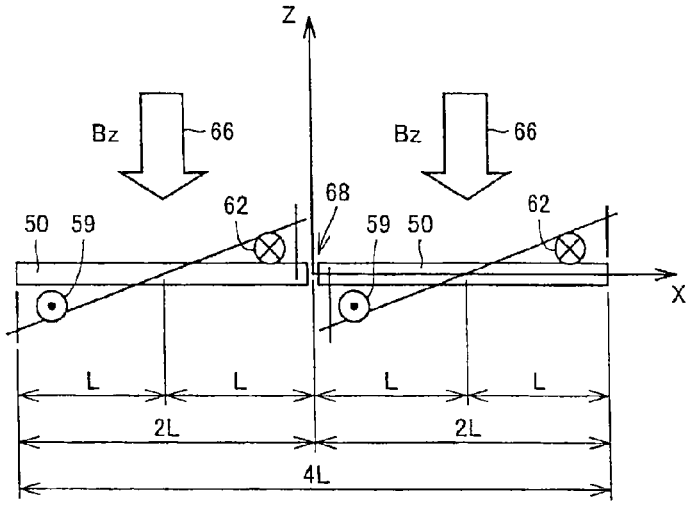
FIG. 14 is a view schematically showing an eddy current generated when a magnetic field in the vertical direction is applied to a magnetic plate provided with a slit.

Here, the reason why eddy current loss can be reduced by providing slits will be described. FIG. 13 is a view schematically showing an eddy current generated when a magnetic field in a vertical direction is uniformly applied to a magnetic plate. FIG. 14 is a view schematically showing an eddy current generated when a magnetic field in the vertical direction is applied to a magnetic plate provided with a slit.

FIGS. 13 and 14 each show a state where a vertical magnetic field in the direction indicated by arrow 66 is applied to a magnetic plate 50. As shown in FIG. 13, since the frequency is low in a transformer, the eddy current is a current linearly increasing in the X direction. If the applied magnetic field has a constant intensity, the inclination of the eddy current along the X direction is constant. When it is assumed that magnetic plate 50 has a plate width of 4L, the current has an inclination in the X direction of 1, and an integration range of heat generation loss due to the eddy current extends from the center to the end of the plate, the heat generation loss is represented by $2\times\int R\times X^2dx$. The heat generation loss in the state shown in FIG. 13 is 4/3 R.

By providing a slit 68 as shown in FIG. 14, magnetic plate 50 is divided into two magnetic plates 50 each having a length of 2L. In this case, one divided magnetic plate 50 has a heat generation loss of 1/6R. Two divided magnetic plates 50 have a total heat generation loss of 1/3R. Therefore, heat generation loss can be reduced to 1/4 by providing slit 68. Since heat generation loss is reduced with the square of a division number, eddy current loss can be reduced by narrowing an interval between slits. The above relation also applies to Reference Example 1.

Therefore, in shell-type transformer 41, eddy current loss can be efficiently reduced by forming slits to cut eddy currents 56, 57 generated in close region 60. Thus, eddy current loss can be efficiently reduced by forming slits at a position including at least a portion of projection region 46, which is the region where coil 51 is projected onto surface layer magnetic plate 47 in the stacking direction of magnetic plates 49.

Although slits 48 are formed in only surface layer magnetic plate 47 in the present reference example, slits 48 may be formed in predetermined magnetic plates 9 arranged consecutively in the stacking direction of magnetic plates 49. For the rest, the configuration is identical to that of Reference Example 1, and thus the description thereof will not be repeated.

Hereinafter, a shell-type transformer in accordance with Embodiment 1 of the present invention will be described with reference to the drawings.

<Embodiment 1>

In Embodiment 1, slits are formed such that an interval between the slits is narrower at an end portion close to a side surface than that at a central portion of a shaft portion. In other words, a formation density of slits is reduced as a minimum distance from side surface 45 within main surface 44 is increased.

Figure 15:
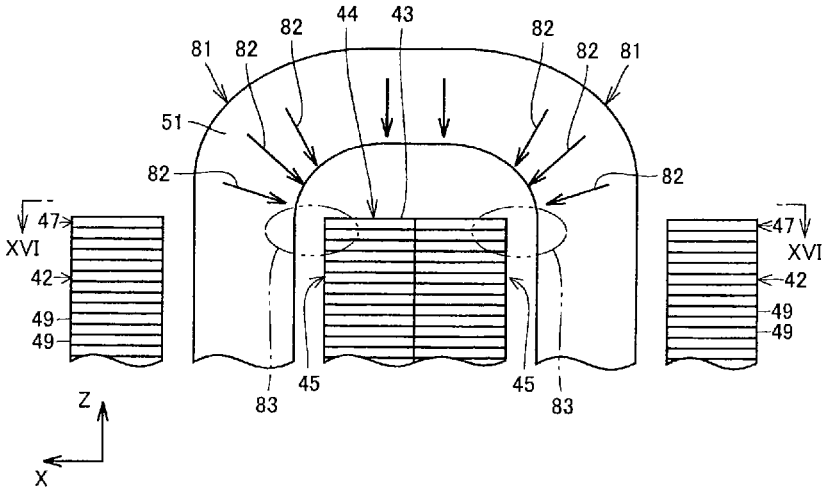
FIG. 15 is a view schematically showing a partial cross section of a shell-type transformer in accordance with Embodiment 1 of the present invention.
Figure 16:
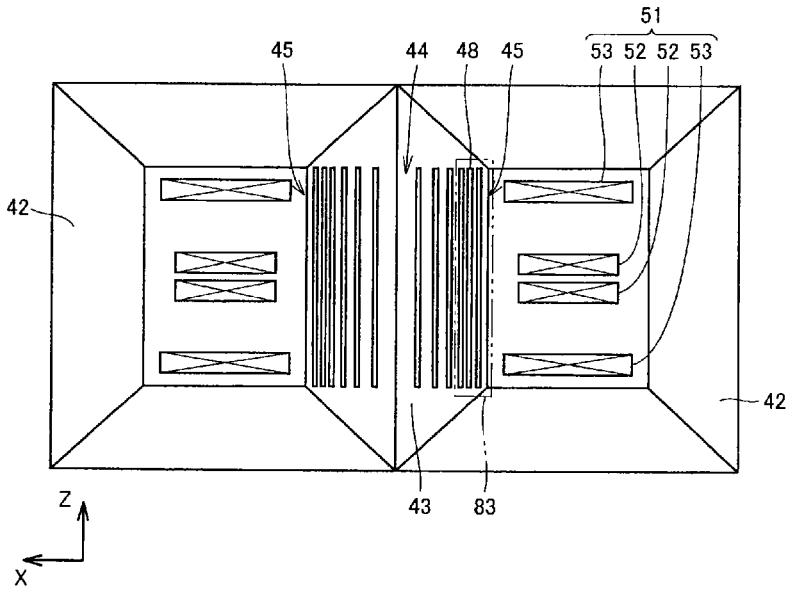
FIG. 16 is a cross sectional view seen in the direction of arrows in a line XVI-XVI in FIG. 15.
Figure 17:
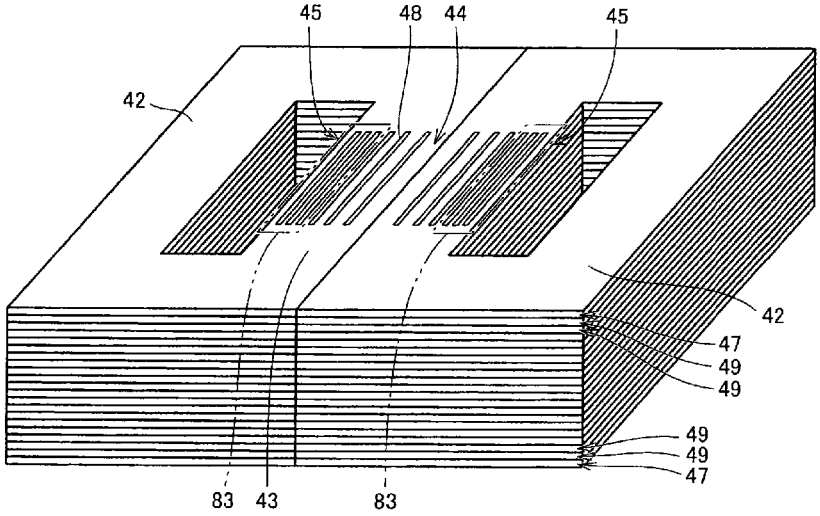
FIG. 17 is a perspective view schematically showing a structure of an iron core in the embodiment.

FIG. 15 is a view schematically showing a partial cross section of a shell-type transformer in accordance with Embodiment 1 of the present invention. FIG. 16 is a cross sectional view seen in the direction of arrows in a line XVI-XVI in FIG. 15. FIG. 17 is a perspective view schematically showing a structure of an iron core in the present embodiment. It is to be noted that FIG. 15 does not show slits for simplicity.

Coil 51 of the shell-type transformer has a substantially rectangular outer shape, including a straight line portion in the X direction, a straight line portion in the Z direction, and an arc portion 81 connecting these straight line portions in FIG. 15. As shown in FIG. 15, by passing a current through coil 51, magnetic fluxes in directions of arrows are generated. Since a length of an inner peripheral side of coil 51 is shorter than a length of an outer peripheral side of coil 51 in each arc portion 81, magnetic fluxes 82 generated in coil 51 are concentrated on the inner peripheral side, and the magnetic fluxes have a high density.

The magnetic fluxes with a high density enter each end portion 83 close to side surface 45, of main surface 44 of shaft portion 43 of iron core 42. Thus, in main surface 44 of shaft portion 43, as the position moves from the central portion to end portion 83 close to side surface 45, a magnetic field applied to iron core 42, in particular, an applied magnetic field entering iron core 42 in a direction perpendicular to main surface 44 of iron core 42, is intensified, leading to an increase in an eddy current generated. Therefore, the increased eddy current can be cut by forming slits at end portion 83 of main surface 44 close to side surface 45.

As shown in FIGS. 16 and 17, in the present embodiment, slits 48 are arranged in parallel within main surface 44 when viewed in a plan view. Further, slits 48 are arranged such that an interval between slits 48 is narrower at end portion 83 close to side surface 45 than that at a central portion within main surface 44. By forming slits 48 as described above, a large eddy current can be cut, and eddy current loss can be reduced. It is to be noted that slits may be formed in combination with the present embodiment and Reference Example 2. For the rest, the configuration is identical to that of Reference Example 2, and thus the description thereof will not be repeated.

Hereinafter, a core-type transformer in accordance with Embodiment 2 of the present invention will be described with reference to the drawings.

<Embodiment 2>

Figure 18:
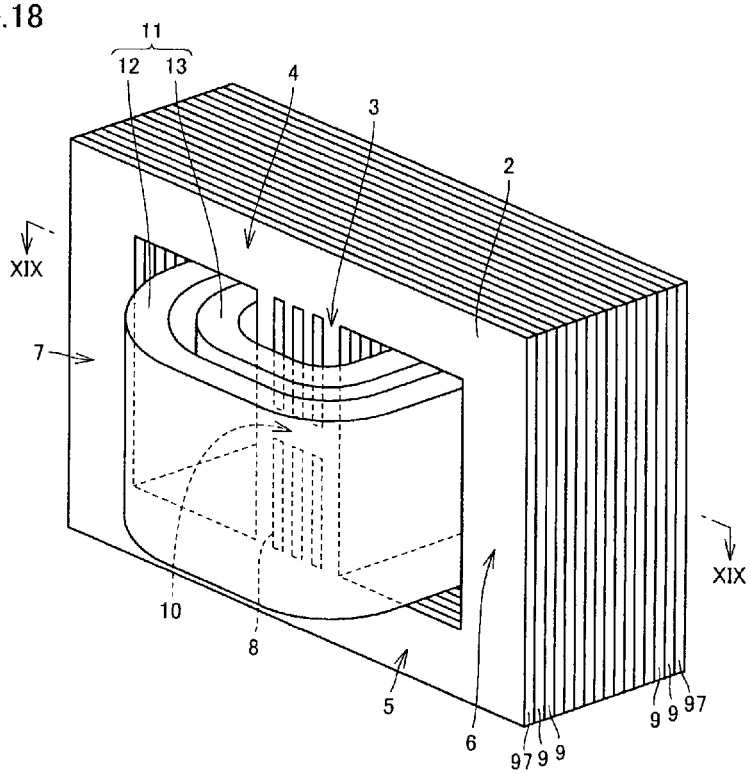
FIG. 18 is a perspective view showing the configuration of the core-type transformer in accordance with Reference Example 1.
Figure 19:
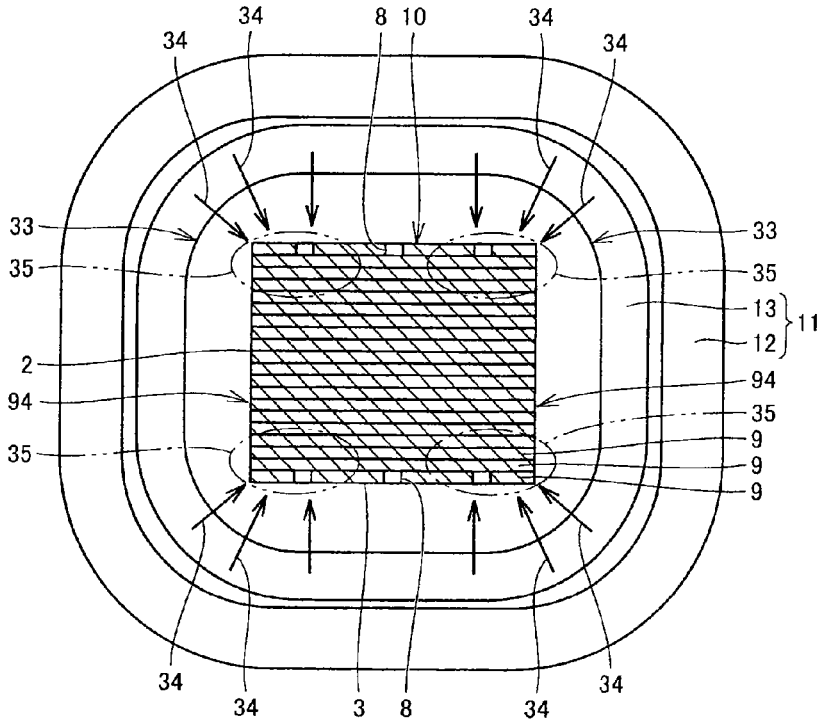
FIG. 19 is a cross sectional view seen from the direction of arrows in a line XIX-XIX in FIG. 18.

In Embodiment 2, Embodiment 1 is applied to a core-type transformer. FIG. 18 is a perspective view showing the configuration of the core-type transformer in accordance with Reference Example 1. FIG. 19 is a cross sectional view seen from the direction of arrows in a line XIX-XIX in FIG. 18.

As shown in FIGS. 18 and 19, coil 11 of the core-type transformer has a substantially rectangular outer shape, and magnetic fluxes indicated by arrows 34 generated in each arc portion 33 has a high density, as in the coil of the shell-type transformer.

The magnetic fluxes with a high density enter each end portion 35 close to side surface 94, of main surface 10 of shaft portion 3 of iron core 2. Thus, in main surface 10 of shaft portion 3, as the position moves from the central portion to end portion 35 close to side surface 94, a magnetic field applied to iron core 2, in particular, an applied magnetic field entering iron core 2 in a direction perpendicular to main surface 10 of iron core 2, is intensified, leading to an increase in an eddy current generated. Therefore, the increased eddy current can be cut by forming a slit at end portion 35 of main surface 10 close to side surface 94.

Figure 20:
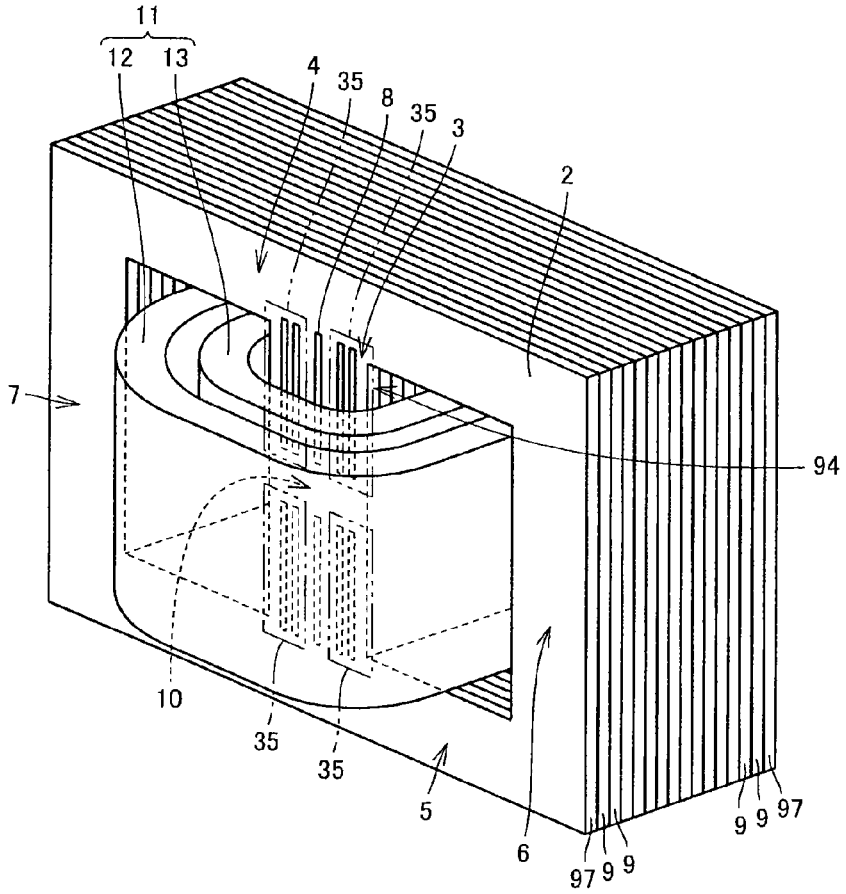
FIG. 20 is a perspective view schematically showing a structure of a core-type transformer in accordance with Embodiment 2 of the present invention.

FIG. 20 is a perspective view schematically showing a structure of a core-type transformer in accordance with Embodiment 2 of the present invention. As shown in FIG. 20, in the present embodiment, a plurality of slits 8 are arranged in parallel within main surface 10 when viewed in a plan view. Further, slits 8 are arranged such that an interval between slits 8 is narrower at end portion 35 close to side surface 94 than that at a central portion within main surface 10. In other words, a formation density of the slits is reduced as a minimum distance from side surface 94 within main surface 10 is increased. By forming slits 8 as described above, a large eddy current can be cut, and eddy current loss can be reduced. For the rest, the configuration is identical to that of Reference Example 1, and thus the description thereof will not be repeated.

Hereinafter, a shell-type transformer in accordance with Embodiment 3 of the present invention will be described with reference to the drawings.

<Embodiment 3>

The shell-type transformer in accordance with Embodiment 3 is a shell-type transformer in which a groove portion is formed in a shaft portion by forming a slit in a predetermined number of magnetic plates arranged consecutively in a stacking direction of the magnetic plates.

Here, the reason why an increase in the intensity of a leakage magnetic field leads to an increase in the depth of entry of the magnetic field into an iron core will be described.

Figure 21:
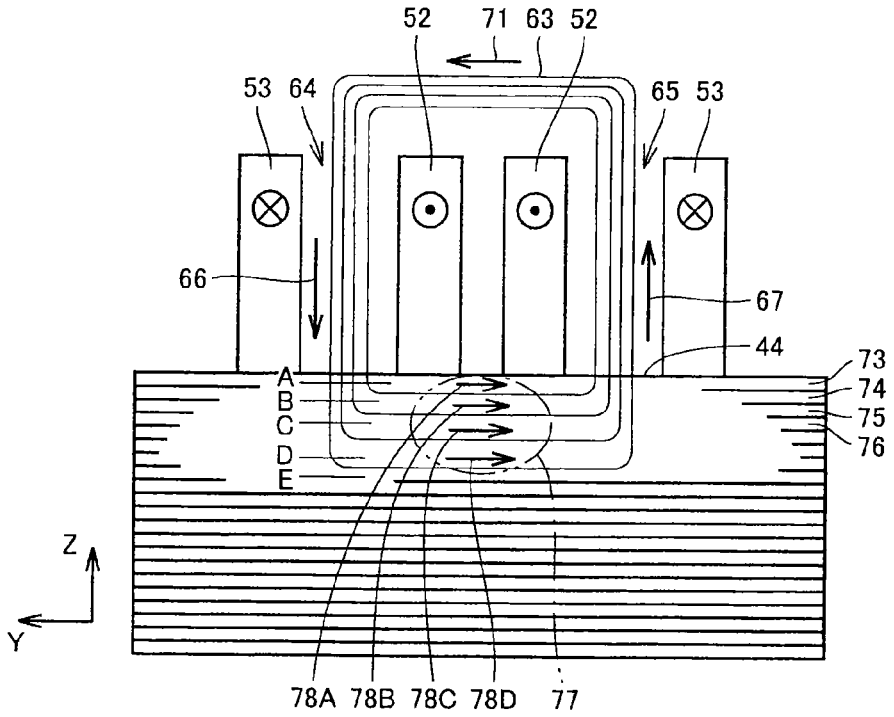
FIG. 21 is a cross sectional view schematically showing a leakage magnetic field generated in a shell-type transformer.

FIG. 21 is a cross sectional view schematically showing a leakage magnetic field generated in a shell-type transformer. As shown in FIG. 21, an iron core is formed by stacking a plurality of magnetic plates including a surface layer magnetic plate 73, a second layer magnetic plate 74, a third layer magnetic plate 75, and a fourth layer magnetic plate 76.

In region 64 between low-voltage coil 53 and high-voltage coil 52, leakage magnetic field 63 is generated in the direction indicated by arrow 66. Thus, the magnetic flux of leakage magnetic field 63 enters surface layer magnetic plate 73 of the iron core in a direction perpendicular to surface layer magnetic plate 73. Inside the iron core, the magnetic flux that has entered changes its direction to directions indicated by arrows 78A to 78D in the Y direction. Further, in region 65 between low-voltage coil 53 and high-voltage coil 52, leakage magnetic field 63 is generated in the direction indicated by arrow 67. Thus, the magnetic flux of leakage magnetic field 63 exits from surface layer magnetic plate 73 of the iron core in the direction perpendicular to surface layer magnetic plate 73. The magnetic flux that has exited changes its direction to a direction indicated by an arrow 71 in the Y direction.

Firstly, a case where leakage magnetic field 63 is weak will be described. Since the iron core is made of stacked steel plates, there is a gap between the steel plates in the Z direction as the stacking direction, causing a large magnetoresistance in the Z direction. Therefore, the magnetic field enters surface layer magnetic plate 73 in the direction of arrow 66, and thereafter the magnetic flux enters in the direction indicated by arrow 78A in the Y direction, which is a rolling direction of the magnetic plates. Thus, the magnetic flux does not enter second layer magnetic plate 74.

If leakage magnetic field 63 is increased, the magnetic flux in the Y direction is increased, causing saturation of surface layer magnetic plate 73 with the magnetic flux in a close region 77 below an interval between adjacent high-voltage coils 52. In this case, a magnetoresistance in the Y direction in surface layer magnetic plate 73 is higher than a magnetoresistance due to a gap between surface layer magnetic plate 73 and second layer magnetic plate 74. As a result, the magnetic flux enters second layer magnetic plate 74.

Although the magnetic flux does not enter third layer magnetic plate 75 until second layer magnetic plate 74 is saturated with the magnetic flux in the Y direction, the magnetic flux enters third layer magnetic plate 75 when second layer magnetic plate 74 is saturated with the magnetic flux in the Y direction. Thus, with an increase in leakage magnetic field 63, the magnetic flux enters a lower magnetic plate. Namely, as a vertically applied magnetic field is intensified, the depth of entry of the magnetic field into the iron core is increased.

Figure 22:
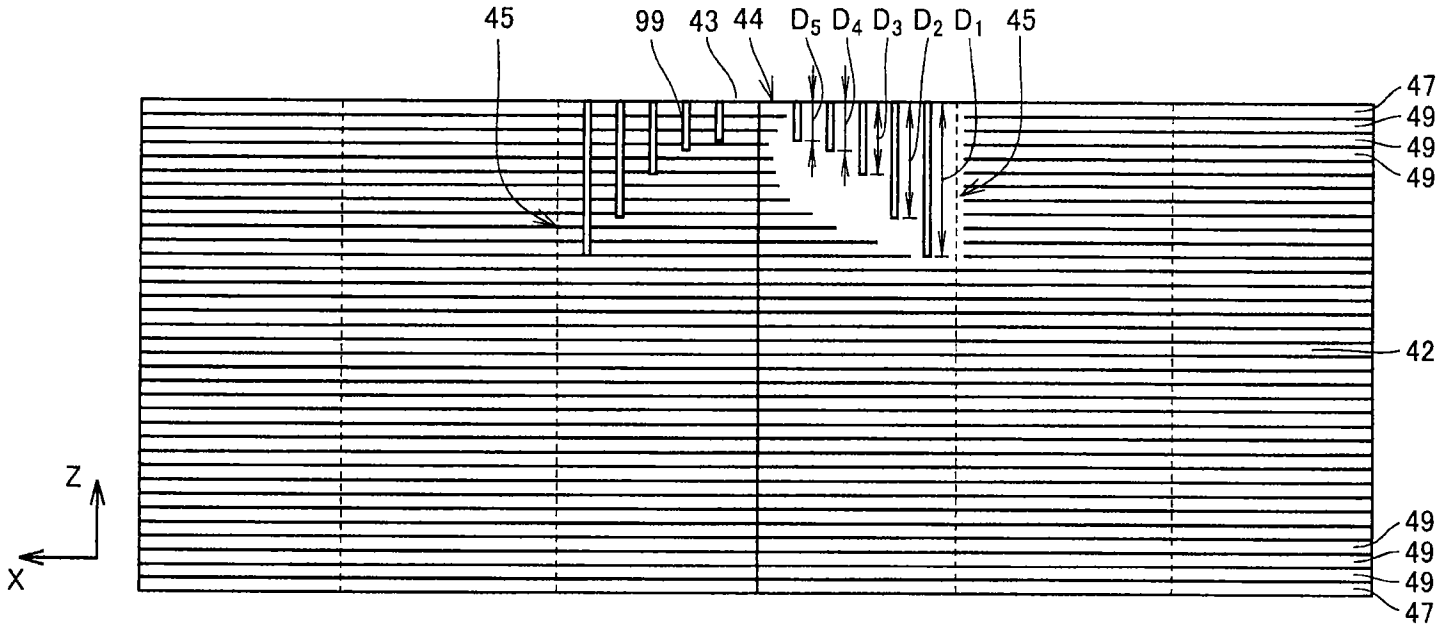
FIG. 22 is a cross sectional view of an iron core provided with grooves having different depths.

FIG. 22 is a cross sectional view of an iron core provided with grooves having different depths. As described above, magnetic fluxes with a high density from a coil enter an end portion close to side surface 45, of main surface 44 of shaft portion 43 of iron core 42. Therefore, the magnetic fluxes enter a lower magnetic plate at a position closer to side surface 45.

In the present embodiment, a slit is formed not only in surface layer magnetic plate 47 of the plurality of magnetic plates 49 arranged in the Z direction, but also in magnetic plates 49 arranged consecutively from surface layer magnetic plate 47 in the Z direction. By forming slit 48 in a predetermined number of magnetic plates 49 including surface layer magnetic plate 47 and arranged consecutively in the stacking direction of the plurality of magnetic plates 49 as described above, a groove portion 99 is formed in shaft portion 43.

As shown in FIG. 22, if depths of groove portions 99 are referred to as $D_1$, $D_2$, $D_3$, $D_4$, and $D_5$, from the one located close to side surface 45, the depths are set as $D_1>D_2>D_3>D_4>D_5$. Thereby, an eddy current generated by a magnetic flux that has deeply entered iron core 42 can be cut by groove portions 99, and eddy current loss can be reduced.

As described above, a plurality of groove portions 99 are arranged in parallel within main surface 44 when viewed in a plan view, and formed to be deeper at the end portion close to side surface 45 than at a central portion within main surface 44. In other words, a formation density of slits is reduced as a distance from main surface 44 on a side close to the slits in the stacking direction of magnetic plates 49 is increased.

Next, a method for determining a depth of groove portion 99 will be described.

In FIG. 21, four magnetic flux lines indicated by arrows 78A to 78D enter the iron core. Below region 64 between low-voltage coil 53 and high-voltage coil 52, the number of entering magnetic flux lines is reduced as the depth in the Z direction becomes deeper from A to D. Specifically, the number of magnetic flux lines entering deeper than a depth A is four, the number of magnetic flux lines entering deeper than a depth B is three, the number of magnetic flux lines entering deeper than a depth C is two, the number of magnetic flux lines entering deeper than a depth D is one, and the number of magnetic flux lines entering deeper than a depth E is zero. Therefore, a magnetic field in the vertical direction entering the iron core is linearly decreased in accordance with the depth from the main surface of the iron core.

On the other hand, below a position between adjacent high-voltage coils 52, the magnetic flux is directed in the Y direction. However, there is one magnetic flux line in a horizontal direction indicated by arrow 78A that passes through surface layer magnetic plate 73. There is one magnetic flux line in the horizontal direction indicated by arrow 78B that passes through second layer magnetic plate 74. There is one magnetic flux line in the horizontal direction indicated by arrow 78C that passes through third layer magnetic plate 75. There is one magnetic flux line in the horizontal direction indicated by arrow 78D that passes through fourth layer magnetic plate 76. Namely, the magnetic flux in the Y direction is constant from main surface 44 to depth D, and becomes zero at a position deeper than D.

Figure 23:
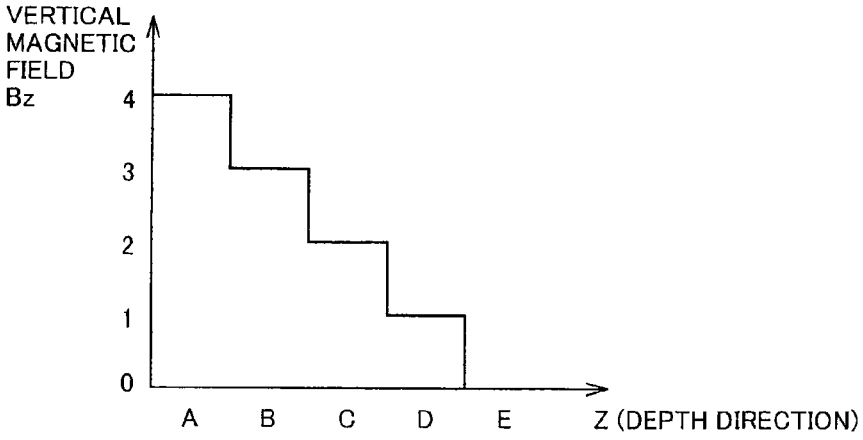
FIG. 23 is a view showing the relation between magnetic flux lines in the vertical direction and depths shown in FIG. 21.
Figure 24:
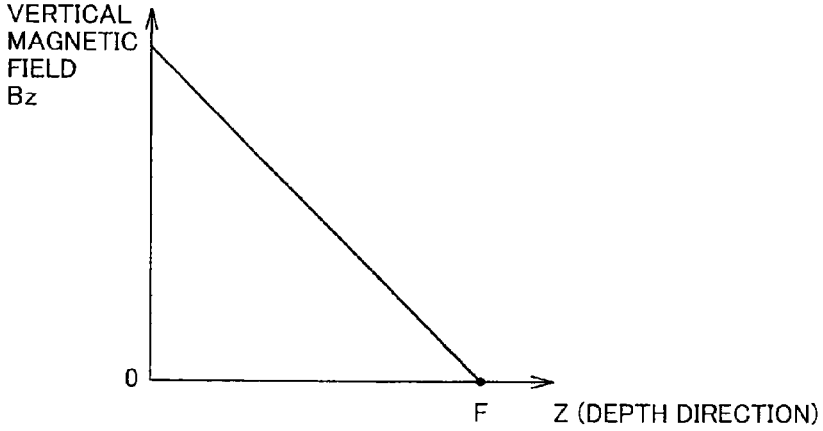
FIG. 24 is a view showing magnetic flux distribution in the vertical direction in a region between a high-voltage coil and a low-voltage coil.

FIG. 23 is a view showing the relation between the magnetic flux lines in the vertical direction and the depths shown in FIG. 21. FIG. 24 is a view showing magnetic flux distribution in the vertical direction in a region between a high-voltage coil and a low-voltage coil. In FIGS. 23 and 24, the axis of ordinate represents magnetic field intensity in the vertical direction, and the axis of abscissa represents depth from the main surface.

As shown in FIG. 23, as the depth from the main surface is increased from A to E, the magnetic field intensity in the vertical direction is reduced from 4 to 0. Since magnetic plate 49 actually has a thin thickness when compared with the depth of entry of the magnetic flux, the vertical magnetic field is linearly attenuated with respect to the depth, as shown in FIG. 24. The depth of entry of the magnetic flux can be substantially determined from an intersection point F between the linear line and the axis of abscissa. Namely, it is desirable to determine, in a coil through which a rated current is passed, the depth of entry of the magnetic flux from an intersection point between a linearly approximated straight line and the axis of abscissa, and form a groove portion to the depth.

In this case, the groove portion is formed at a position where a position between low-voltage coil 53 and high-voltage coil 52 is projected onto the magnetic plates in the stacking direction of the magnetic plates, to a depth where the magnetic flux entering the iron core in the stacking direction of the magnetic plates reaches.

Figure 25:
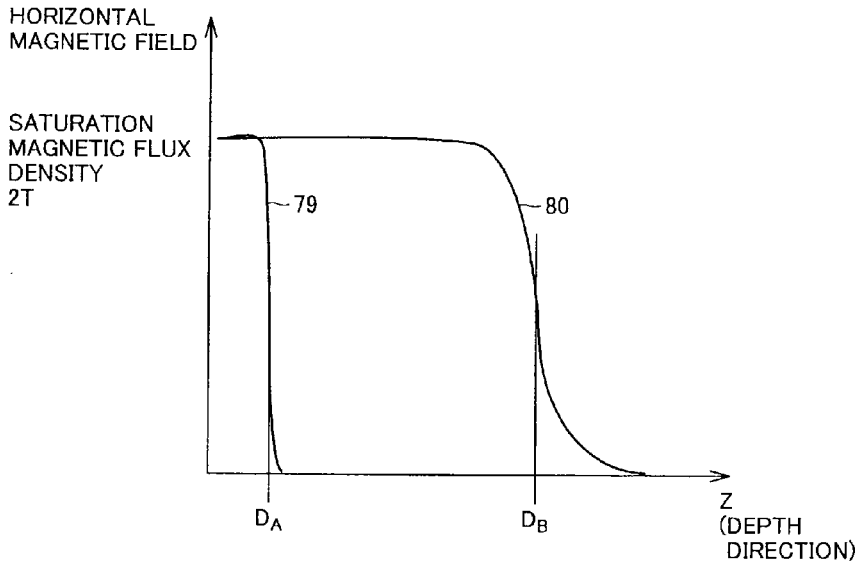
FIG. 25 is a view showing distribution of a magnetic field in a horizontal direction in an iron core below a position between adjacent high-voltage coils.

FIG. 25 is a view showing distribution of a magnetic field in the horizontal direction in the iron core below the position between the adjacent high-voltage coils. In FIG. 25, the axis of ordinate represents magnetic field intensity in the horizontal direction, and the axis of abscissa represents depth from the main surface. FIG. 25 shows a curved line 79 in the case of a weak magnetic field and a curved line 80 in the case of rated excitation.

As shown in FIG. 25, in the iron core below the position between the adjacent high-voltage coils, a portion where the magnetic field is present is saturated with the magnetic flux. Accordingly, the magnetic field intensity in the portion where the magnetic field is present is constant at a saturation magnetic flux density, and the magnetic field intensity is drastically reduced and becomes zero at the depth of entry of the magnetic field. The depth of entry of the magnetic flux can be determined from a depth $D_A$ or a depth $D_B$ where the magnetic field drastically changes. In particular, it is preferable to determine the depth of entry of the magnetic field from depth $D_B$ in the case of rated excitation.

In this case, the groove portion is formed at a position where the low-voltage coil or the high-voltage coil is projected onto the magnetic plates in the stacking direction of the magnetic plates, to a depth where a magnetic flux passing through the iron core in the axial direction of the shaft portion is generated.

By forming the groove portion to the depth of entry of the magnetic field determined as described above, an eddy current generated inside the iron core can be reliably cut, and thus eddy current loss can be effectively reduced. It is to be noted that slits may be formed in combination with the present embodiment and Reference Examples 2, 3. For the rest, the configuration is identical to those of Reference Example 2 and Embodiment 1, and thus the description thereof will not be repeated.

Hereinafter, a core-type transformer in accordance with Embodiment 4 of the present invention will be described with reference to the drawings.

<Embodiment 4>

In Embodiment 4, Embodiment 3 is applied to a core-type transformer.

Figure 26:
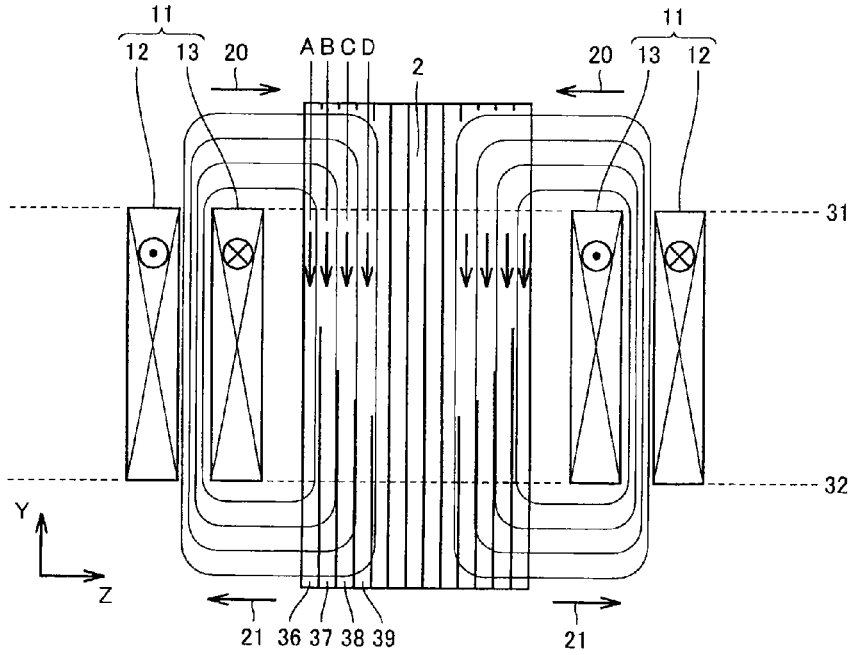
FIG. 26 is a view showing magnetic flux lines in a cross section of a core-type transformer corresponding to FIG. 3.

FIG. 26 is a view showing magnetic flux lines in a cross section of a core-type transformer corresponding to FIG. 3. As shown in FIG. 26, broken line 31 indicates the upper end position of coil 11, and broken line 32 indicates the lower end position of coil 11. In the range between broken line 31 and broken line 32, magnetic flux lines directed downward in the Y direction are generated in iron core 2, from the main surface of iron core 2 to depth D.

Four magnetic flux lines indicated by arrows enter the iron core from one main surface. In the range between broken line 31 and broken line 32, the number of entering magnetic flux lines is reduced as the depth in the Z direction becomes deeper from A to D.

Since the depth of entry of the magnetic flux into the iron core can be determined as in the shell-type transformer of Embodiment 3, the description thereof will not be repeated. However, unlike the shell-type transformer, the magnetic field is generated in the vicinity of both end portions of coil 11.

Therefore, a groove portion is formed at a position where a position of end portions of low-voltage coil 13 and high-voltage coil 12 in the axial direction of the shaft portion is projected onto magnetic plates 36 to 39 in the stacking direction of the magnetic plates, to a depth where a magnetic flux entering iron core 2 in the stacking direction of the magnetic plates reaches.

Alternatively, a groove portion is formed at a position where a position of central portions of low-voltage coil 13 and high-voltage coil 12 in the axial direction of the shaft portion of iron core 2 is projected onto the magnetic plates in the stacking direction of the magnetic plates, to a depth where a magnetic flux passing through iron core 2 in the axial direction is generated. The position of the central portions refers to a position between broken line 31 and broken line 32.

By forming the groove portion to the depth of entry of the magnetic field determined as described above, an eddy current generated inside the iron core can be reliably cut, and thus eddy current loss can be effectively reduced. It is to be noted that slits may be formed in combination with the present embodiment, Reference Example 1, and Embodiment 2. For the rest, the configuration is identical to those of Reference Example 1 and Embodiment 2, and thus the description thereof will not be repeated. Also in the present embodiment, the formation density of the slits is reduced as the distance from the main surface on the side close to the slits in the stacking direction of the magnetic plates is increased.

Hereinafter, a shell-type transformer and a core-type transformer in accordance with Embodiment 5 of the present invention will be described with reference to the drawings.

<Embodiment 5>

In Embodiment 5, an iron core is provided with step portions and groove portions.

Figure 27:
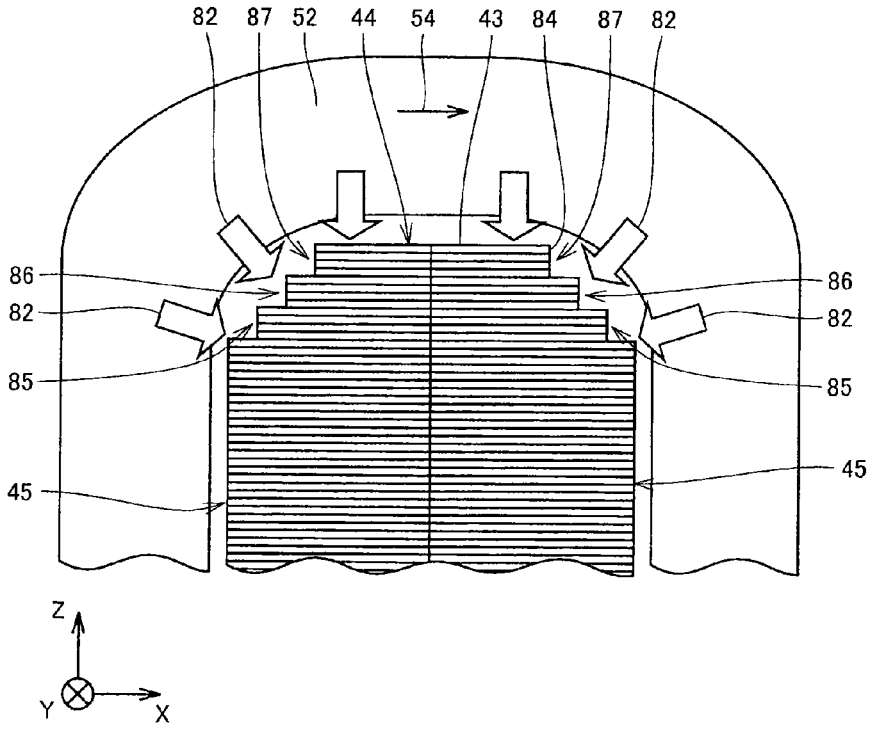
FIG. 27 is a partial cross sectional view of a shell-type transformer including an iron core having step portions.
Figure 28:
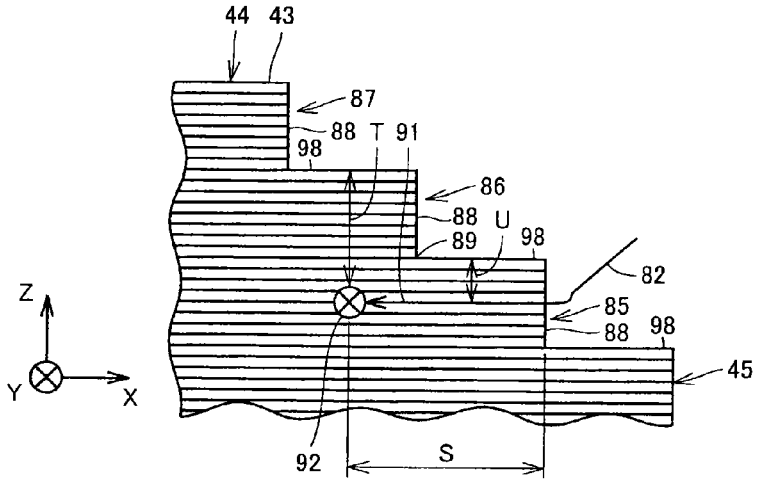
FIG. 28 is a partial cross sectional view of the iron core having step portions.

FIG. 27 is a partial cross sectional view of a shell-type transformer including an iron core having step portions. FIG. 28 is a partial cross sectional view of the iron core having step portions. FIGS. 27 and 28 do not show a groove portion for simplicity.

As shown in FIGS. 27 and 28, in the shell-type transformer having step portions, shaft portion 43 has step portions 85, 86, 87 whose widths between side surfaces 45 are narrowed in a stepwise manner as they are located closer to the inner peripheral surface of high-voltage coil 52 in the stacking direction of the magnetic plates. Step portions 85, 86, 87 each include a step front surface 98 parallel to main surface 44, and a step side surface 88 parallel to side surface 45.

By providing step portions 85, 86, 87 in shaft portion 43 of the iron core, the iron core can be placed more inside high-voltage coil 52, and a space can be effectively used.

By passing a current in the direction indicated by arrow 54 in high-voltage coil 52, a leakage magnetic field which causes entry of magnetic fluxes 82 in directions indicated by arrows in the drawing is generated. As shown in FIG. 28, on a side surface 45 side of the iron core, a leakage magnetic field generated at the straight line portion in the Z direction of the coil has an increased influence, and a magnetic flux enters from side surface 45 or step side surface 88 as the position moves closer to the inner peripheral surface of the coil. In this case, the magnetic flux enters from the direction perpendicular to the stacking direction of the magnetic plates, and thus eddy current loss is little if a groove portion is not provided.

Here, a path of a magnetic flux in an iron core having step portions and not provided with a groove portion will be described. In particular, a path of magnetic flux 82 entering step portion 85 located at a position close to side surface 45 will be described. As shown in FIG. 28, magnetic flux 82 enters the iron core, at a position between a low-voltage coil and a high-voltage coil not shown, in the direction perpendicular to the stacking direction of the magnetic plates. In this case, eddy current loss due to entry of magnetic flux 82 is hardly generated.

Magnetic flux 82 that has entered the iron core travels from step side surface 88 by a distance S, then changes its direction to the Y direction and continues entering, and thereafter changes the direction again and finally exits out of the iron core from a position between a low-voltage coil and a high-voltage coil not shown. Generally, the magnetic plates subjected to entry of a magnetic flux are saturated with the magnetic flux at a position below a position between adjacent high-voltage coils. Therefore, magnetic flux 82 that has entered the iron core does not change its direction to the Y direction immediately after entry, but spreads in the X direction, which is a direction perpendicular to the rolling direction of the magnetic plates.

Figure 29:
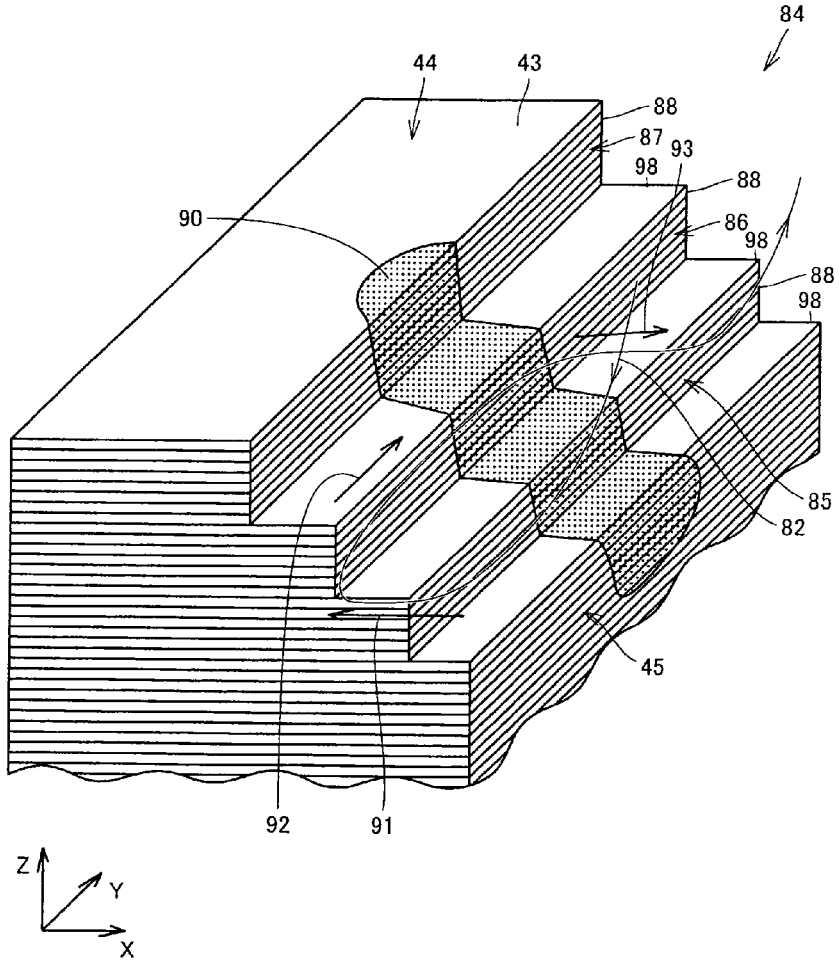
FIG. 29 is a partial perspective view showing a path of a magnetic flux that has entered the iron core having step portions.

FIG. 29 is a partial perspective view showing the path of the magnetic flux that has entered the iron core having step portions. As shown in FIG. 29, a saturation portion 90 saturated with the magnetic flux appears at a central portion of the step portions of the iron core in the Y direction.

As shown in FIG. 28, as distance S for which magnetic flux 82 enters in the X direction is increased, distance S becomes greater than a distance T from step front surface 98 of step portion 87 and a distance U from step front surface 98 of step portion 86. Since the magnetic flux density in the Y direction of the magnetic plates is reduced with increasing distance from step front surface 98, magnetic flux 82 is likely to be directed in the Y direction with an increase in entry distance S of magnetic flux 82. Therefore, finally, all magnetic fluxes are directed in the Y direction, and thereafter change their direction again to the X direction and exit out of the iron core.

As shown in FIG. 29, magnetic flux 82 that has entered from step side surface 88 of step portion 85 as the first step from the bottom enters in the X direction to avoid saturation portion 90, then changes its direction to the Y direction, and is further directed in the X direction again and exits from step side surface 88 of step portion 85.

When the magnetic flux passes as described above, a magnetic field component in the vertical direction of the magnetic plates (i.e., a direction perpendicular to a plate surface) is not generated, and thus eddy current loss is hardly generated. However, eddy current loss due to a magnetic flux entering the magnetic plates in the vertical direction is generated, as described in Reference Examples 1, 2 and Embodiments 1 to 4.

Figure 30:
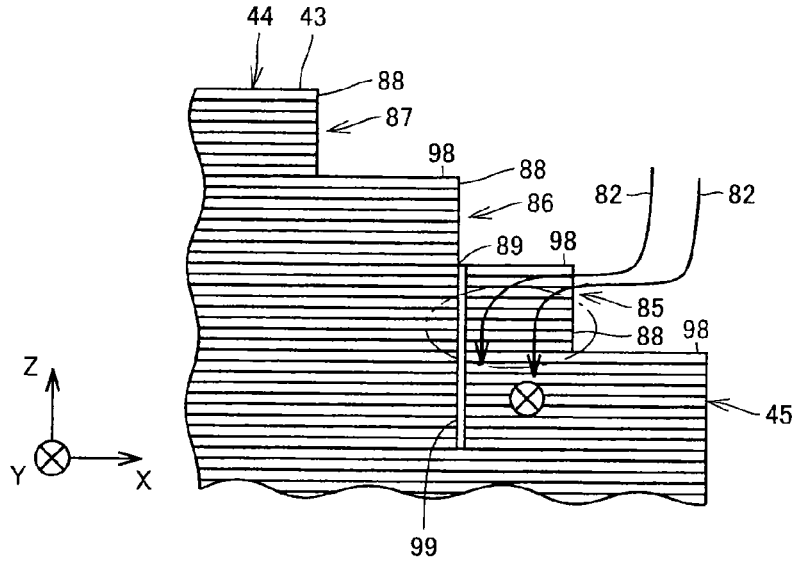
FIG. 30 is a partial cross sectional view showing an iron core provided with a groove portion at a corner of a step portion.
Figure 31:
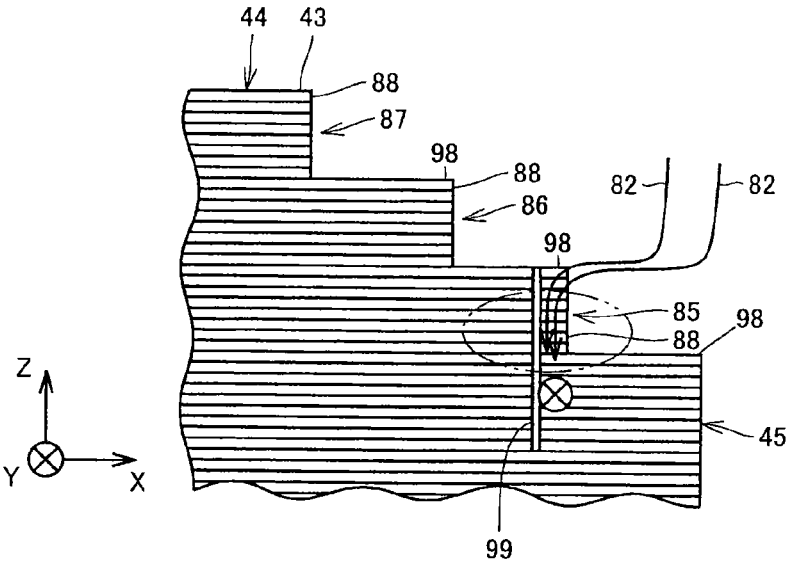
FIG. 31 is a partial cross sectional view showing an iron core provided with a groove portion in the vicinity of a step side surface.

Next, a case where a groove portion is provided in an iron core having step portions will be described. In this case, unlike the foregoing, eddy current loss is increased. The reason therefor will be described below. FIG. 30 is a partial cross sectional view showing an iron core provided with a groove portion at a corner of a step portion. FIG. 31 is a partial cross sectional view showing an iron core provided with a groove portion in the vicinity of a step side surface.

As shown in FIG. 30, although magnetic fluxes 82 that have entered the iron core from step side surface 88 of step portion 85 attempt to spread in the X direction, the presence of groove portion 99 causes a large magnetoresistance, and thus magnetic fluxes 82 cannot spread in the X direction beyond groove portion 99. On the other hand, since the central portion in the Y direction of the iron core is saturated with the magnetic flux, magnetic fluxes 82 cannot spread in the Y direction, either. In the Z direction, although there is a minute gap between the stacked steel plates, the gap is smaller than a gap of groove portion 99, and thus magnetic fluxes 82 change their direction to the Z direction. As a result, the magnetic fluxes enter the iron core in the direction perpendicular to the magnetic plates, which causes large eddy current loss.

When groove portion 99 is provided in the vicinity of step side surface 88 of step portion 85 as shown in FIG. 31, magnetic fluxes 82 that have entered the iron core change their direction to the Z direction before they fully spreads in the X direction. Therefore, more magnetic fluxes enter the iron core in the direction perpendicular to the magnetic plates, which causes larger eddy current loss.

When groove portion 99 is provided as described above, large heat generation, in particular locally large heat generation occurs, because eddy current loss is proportional to the square of the magnetic field intensity. The heat generation causes a problem such as deterioration of an insulation oil in the transformer. Therefore, when a groove portion is provided in an iron core having step portions, it is necessary to form the groove portion at a position away from a step side surface and a side surface.

Figure 32:
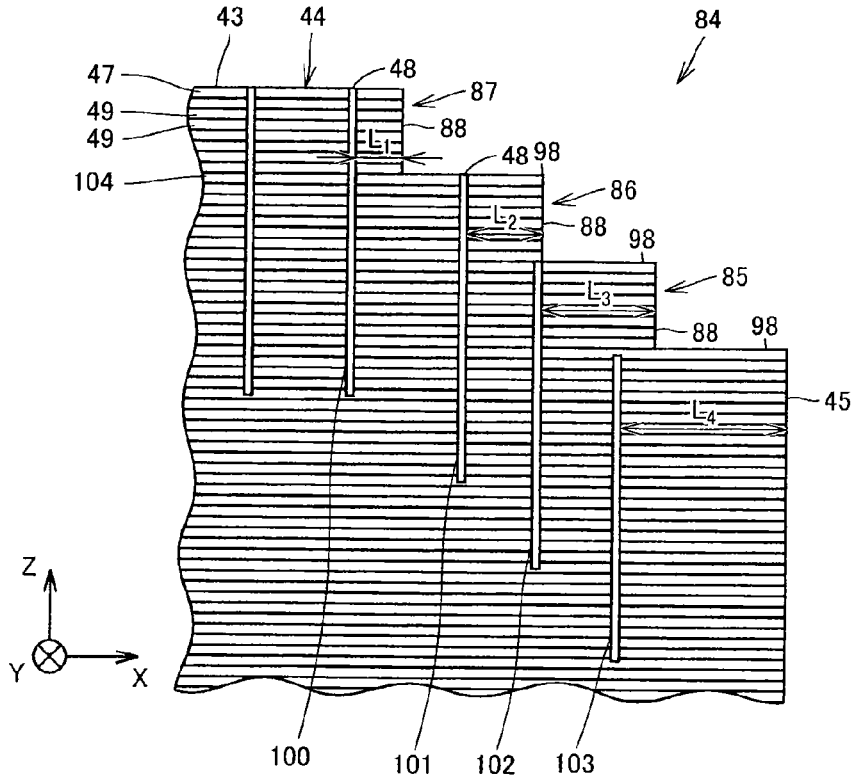
FIG. 32 is a partial cross sectional view showing a structure of an iron core having step portions and groove portions in accordance with Embodiment 5 of the present invention.

FIG. 32 is a partial cross sectional view showing a structure of an iron core having step portions and groove portions in accordance with Embodiment 5 of the present invention. As shown in FIG. 32, step portions 85, 86, 87 described above are formed in an iron core 84 of the present embodiment.

In iron core 84, a groove portion 100 as a first groove portion is formed in shaft portion 43 by forming slit 48 in a predetermined number of magnetic plates 49 including surface layer magnetic plate 47 and arranged consecutively in the stacking direction of magnetic plates 49.

Further, in iron core 84, a groove portion 101 as a second groove portion is formed in shaft portion 43 by forming slit 48 in a predetermined number of magnetic plates 49 including a step surface layer magnetic plate 104 constituting step front surface 98 and arranged consecutively from step surface layer magnetic plate 104 toward inside of shaft portion 43 in the stacking direction of magnetic plates 49.

In the present embodiment, a groove portion 102 and a groove portion 103 as the second groove portions are further provided. Groove portion 100 extends from main surface 44 downward in the Z direction. Groove portion 101 extends from step front surface 98 of step portion 87 downward in the Z direction. Groove portion 102 extends from step front surface 98 of step portion 86 downward in the Z direction. Groove portion 103 extends from step front surface 98 of step portion 85 downward in the Z direction.

A plurality of groove portions 100 are arranged in parallel within main surface 44 when viewed in a plan view. Groove portions 101 to 103 are each arranged within step front surface 98 when viewed in a plan view.

A minimum distance between groove portion 100 and opposing step side surface 88 is referred to as $L_1$. A minimum distance between groove portion 101 and opposing step side surface 88 is referred to as $L_2$. A minimum distance between groove portion 102 and opposing step side surface 88 is referred to as $L_3$. A minimum distance between groove portion 103 and opposing side surface 45 is referred to as $L_4$.

As described above, it is preferable to increase distances between the groove portions and side surface 45 and step side surface 88. Further, with increasing distance from main surface 44 in the Z direction, more magnetic fluxes enter in the X direction from side surface 45 and step side surface 88.

Thus, preferably, the minimum distances described above satisfy the relation $L_4>L_3>L_2>L_1$. In other words, preferably, minimum distance $L_2$ between groove portion 101 and step side surface 88 opposed to groove portion 101 is greater than minimum distance $L_1$ between groove portion 100 and step side surface 88 opposed to groove portion 100. Thereby, eddy current loss due to a magnetic field entering from side surface 45 and step side surface 88 of iron core 84 can be reduced.

It is to be noted that, although a groove portion may be provided inside iron core 84, such as groove portion 103, if a groove portion is formed close to the central portion in the X direction of shaft portion 43, eddy current loss due to a magnetic field vertically entering magnetic plates 49 of iron core 84 is increased. Therefore, it is desirable to determine a position for forming a groove portion, taking eddy current loss due to a vertical magnetic field into consideration.

Figure 33:
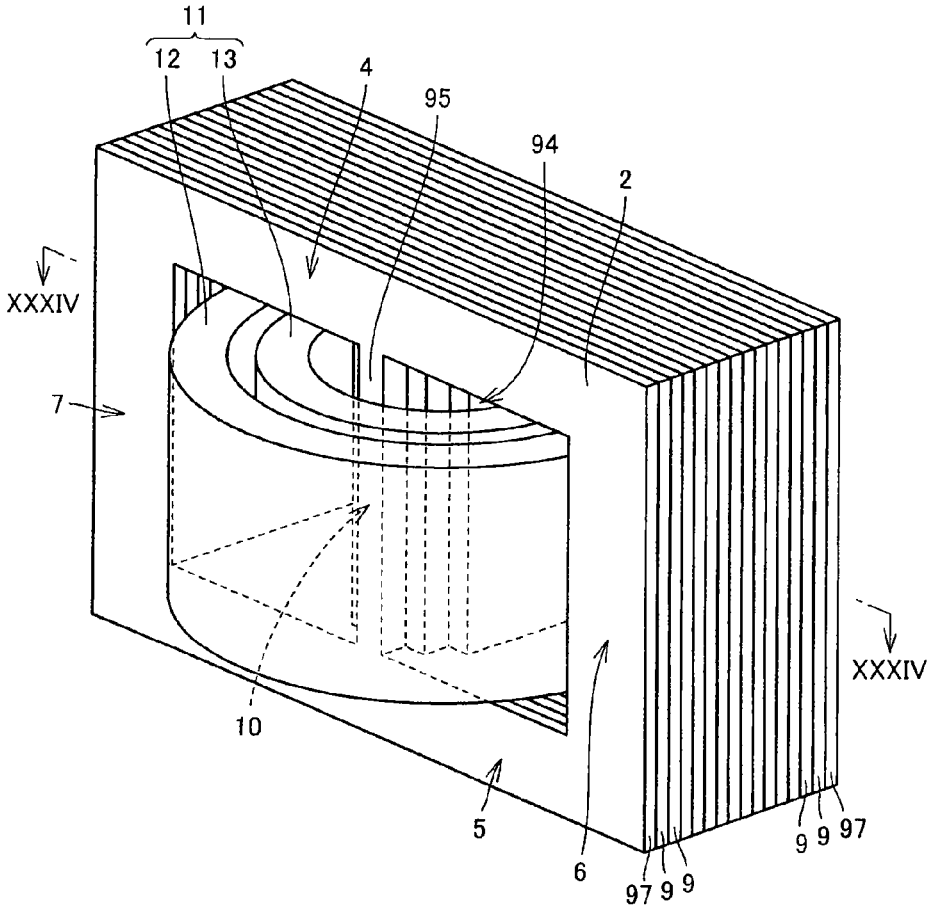
FIG. 33 is a perspective view showing a configuration of a core-type transformer including the iron core having step portions and groove portions in accordance with the embodiment.
Figure 34:
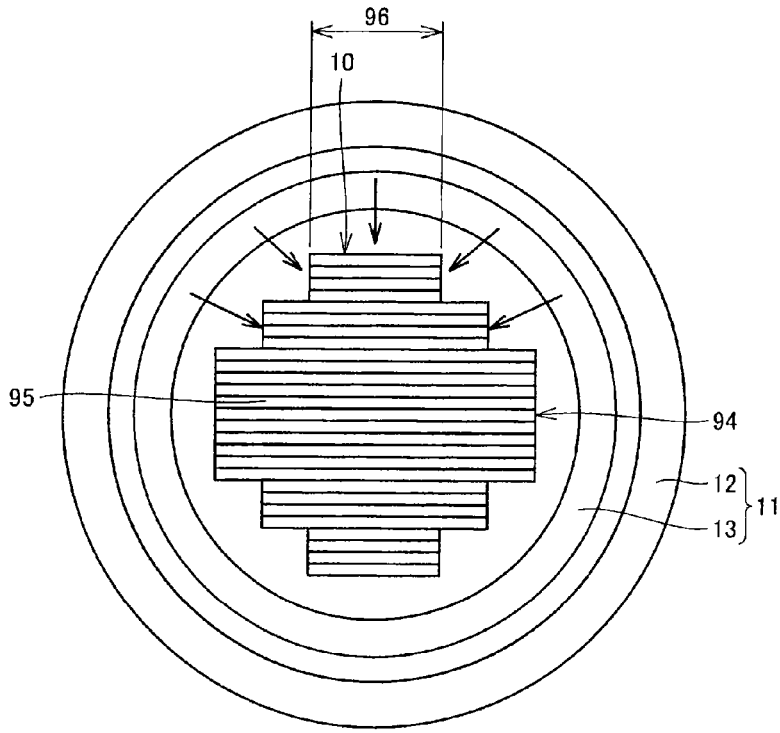
FIG. 34 is a cross sectional view seen from the direction of arrows in a line XXXIV-XXXIV in FIG. 33.

FIG. 33 is a perspective view showing a configuration of a core-type transformer including the iron core having step portions and groove portions in accordance with the present embodiment. FIG. 34 is a cross sectional view seen from the direction of arrows in a line XXXIV-XXXIV in FIG. 33. FIG. 34 only shows a shaft portion of the iron core and a coil. Further, FIGS. 33 and 34 do not show groove portions for simplicity.

As shown in FIGS. 33 and 34, the core-type transformer of the present embodiment is a solenoid coil having a circular coil. In such a coil, when step portions corresponding to an inner side of coil 11 are formed in shaft portion 95 of iron core 2, the step portions are greater in size when compared with those in a coil of a shell-type transformer. Thus, main surface 10 has a smaller width 96.

Further, as shown in FIG. 34, a magnetic field enters shaft portion 95 from coil 11 in direction of arrows. As in a shell-type transformer, as the position moves closer to side surface 94, more magnetic fluxes enter in the direction perpendicular to the stacking direction of the magnetic plates. Thus, it is preferable to form a groove portion at a position away from side surface 94. However, since main surface 10 has narrow width 96, it is not possible to form a groove portion at a position avoiding a central portion in a width direction of the shaft portion.

Therefore, it is preferable to form a groove portion at a position having minimum total eddy current loss due to a vertical magnetic field and a horizontal magnetic field applied to the iron core.

Figure 35:
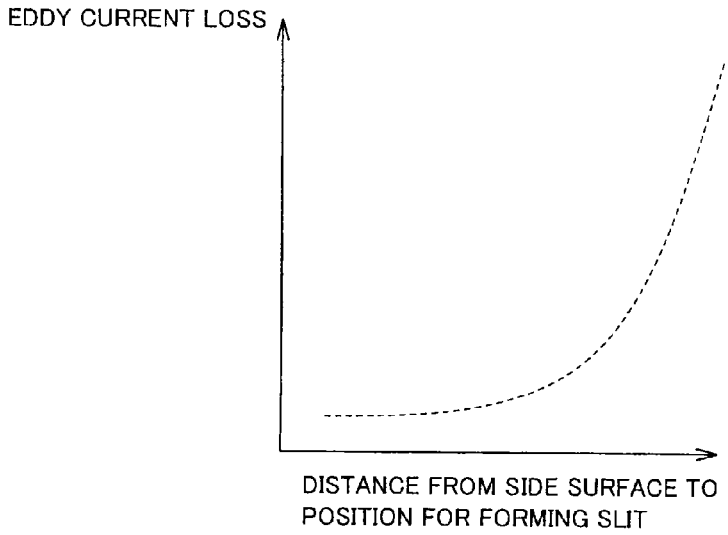
FIG. 35 is a view showing the relation between eddy current loss due to a vertical magnetic field and a distance from a side surface of a shaft portion to a position for forming a slit.
Figure 36:
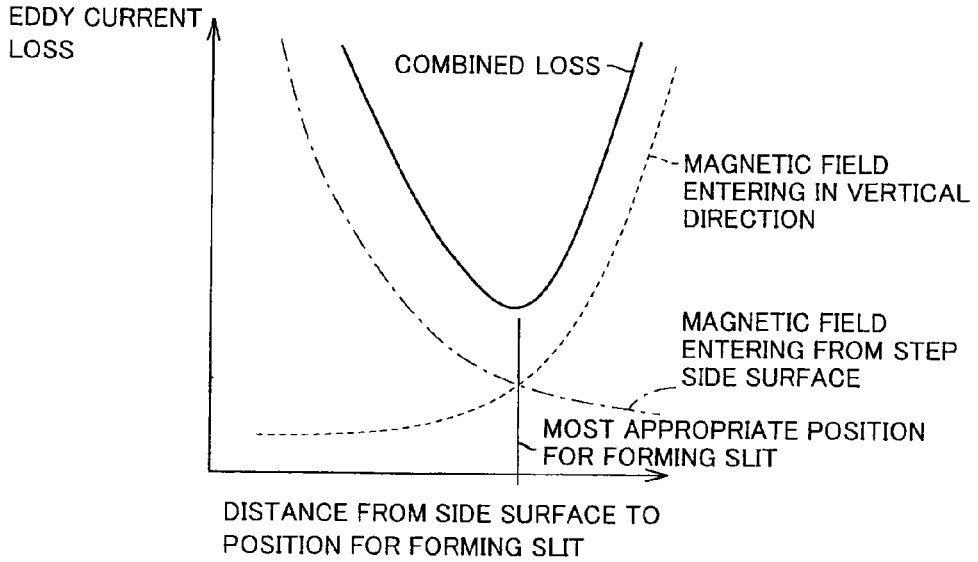
FIG. 36 is a view showing the relation between a vertical magnetic field and a magnetic field entering from a side surface and a distance from the side surface of a shaft portion to a position for forming a slit.

FIG. 35 is a view showing the relation between eddy current loss due to a vertical magnetic field and a distance from a side surface of a shaft portion to a position for forming a slit. FIG. 36 is a view showing the relation between a vertical magnetic field and a magnetic field entering from a side surface and a distance from the side surface of a shaft portion to a position for forming a slit. In FIG. 35, the axis of ordinate represents the eddy current loss due to the vertical magnetic field, and the axis of abscissa represents the distance from the side surface of the shaft portion to the position for forming a slit. In FIG. 36, the axis of ordinate represents eddy current loss, and the axis of abscissa represents the distance from the side surface of the shaft portion to the position for forming a slit.

As shown in FIG. 35, in an iron core not having step portions, as the distance from the side surface of the shaft portion to the position for forming a slit is decreased, the eddy current loss due to the vertical magnetic field is decreased.

As shown in FIG. 36, in an iron core having step portions, as the distance from the side surface of the shaft portion to the position for forming a slit is decreased, eddy current loss due to the vertical magnetic field is decreased, whereas eddy current loss due to the magnetic field entering from the side surface is increased.

Therefore, a position having the lowest combined loss obtained by combining the above relations serves as the most appropriate position for forming a slit. By forming a slit at the position determined as described above, generation of eddy current loss due to the vertical magnetic field and the horizontal magnetic field can be reduced in an integrated manner. In other words, a groove portion is arranged within the step front surface when viewed in a plan view, and its position from the step side surface or the side surface opposed to the groove portion is arranged at a position having a minimum sum of eddy current loss generated by a magnetic flux passing through the iron core in the stacking direction and eddy current loss generated by a magnetic flux passing through the iron core in the direction perpendicular to the stacking direction. Since the most appropriate position for forming a slit differs for each step portion, it is preferable to form a slit at the most appropriate position in each step portion. Setting of the most appropriate position for forming a slit described above can also be adapted to a shell-type transformer.

It is to be noted that, also in the present embodiment, the formation density of the slits is reduced as the distance from the main surface on the side close to the slits in the stacking direction of the magnetic plates is increased.

Hereinafter, a shell-type transformer in accordance with Embodiment 6 of the present invention will be described with reference to the drawings.

<Embodiment 6>

In a shell-type transformer including an iron core having step portions as shown in FIG. 27, magnetic fluxes having a high density enter each end portion close to side surface 45, in main surface 44 of shaft portion 43 of iron core 84. Accordingly, of magnetic fluxes that have entered main surface 44, the magnetic fluxes that have entered each end portion close to side surface 45 enter a further lower magnetic plate.

Figure 37:
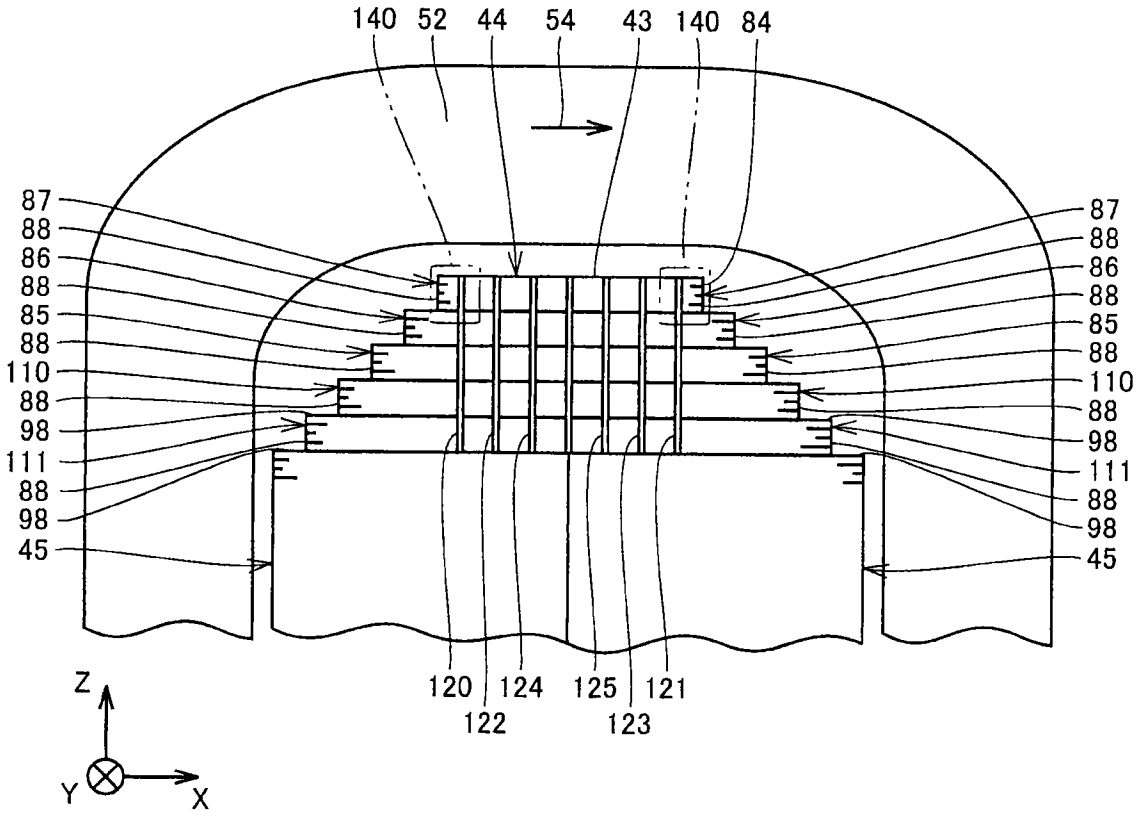
FIG. 37 is a partial cross sectional view of a shell-type transformer including an iron core provided with equally spaced groove portions having a uniform depth, as a comparative example of a shell-type transformer in accordance with Embodiment 6.

FIG. 37 is a partial cross sectional view of a shell-type transformer including an iron core provided with equally spaced groove portions having a uniform depth, as a comparative example of the shell-type transformer in accordance with the present embodiment.

As shown in FIG. 37, in the shell-type transformer of the comparative example, shaft portion 43 has step portions 85, 86, 87, 110, 111 whose widths between side surfaces 45 are narrowed in a stepwise manner as they are located closer to the inner peripheral surface of high-voltage coil 52 in the stacking direction of the magnetic plates. Step portions 110, 111 each include step front surface 98 parallel to main surface 44, and step side surface 88 parallel to side surface 45. Since step portions 85, 86, 87 are identical to those in the shell-type transformer of Embodiment 5, the description thereof will not be repeated.

By passing a current in the direction indicated by arrow 54 in high-voltage coil 52, a leakage magnetic field is generated. As described above, magnetic fluxes entering the magnetic plates in the vertical direction due to the generated leakage magnetic field are most concentrated at each region 140 surrounded by a chain double-dashed line in the drawing, which is each end portion close to side surface 45 in main surface 44.

Thus, in the shell-type transformer of the comparative example, a groove portion 120 extending from main surface 44 to reach a depth of step front surface 98 of step portion 111 is provided to pass through region 140 on the left side in the drawing. Further, a groove portion 121 extending from main surface 44 to reach the depth of step front surface 98 of step portion 111 is provided to pass through region 140 on the right side in the drawing. Furthermore, in the shell-type transformer of the comparative example, equally spaced groove portions 122, 123, 124, 125 having the same depth are provided between groove portion 120 and groove portion 121.

The shell-type transformer of the comparative example has six groove portions in steps of shaft portion 43 of iron core 84, and a formation density of slits constituting the groove portions is constant in the stacking direction of the magnetic plates, irrespective of the distance from main surface 44. Further, since the six groove portions are formed at equal intervals, the formation density of the slits is constant within main surface 44, irrespective of the minimum distance from side surface 45. Here, the formation density of the slits refers to the number of formed slits per unit area of a magnetic plate when seen in a plan view.

Figure 38:
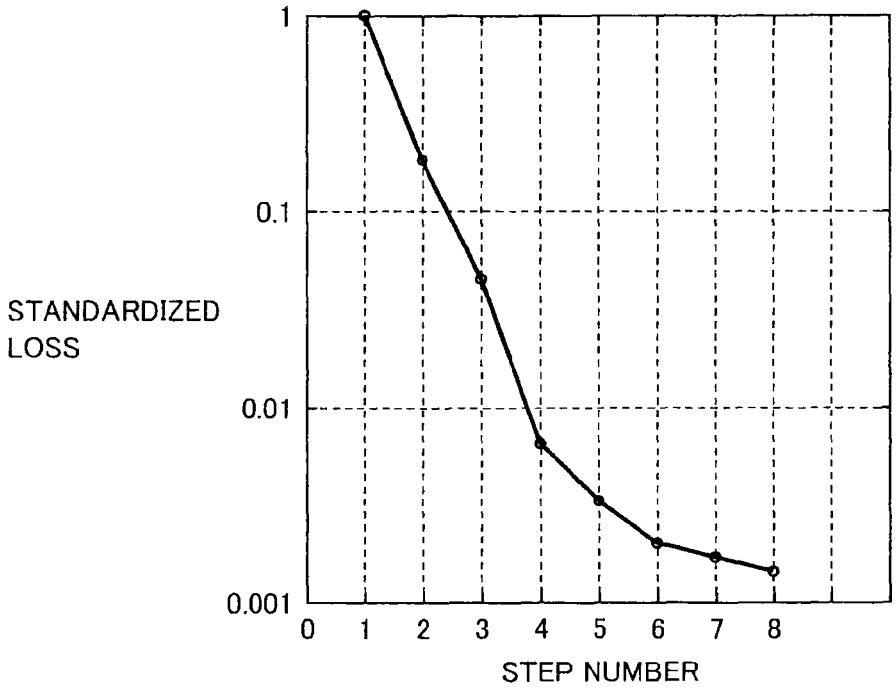
FIG. 38 is a view of simulation analysis on heat generation loss caused in a shaft portion of an iron core not having a groove portion.

FIG. 38 is a view of simulation analysis on heat generation loss caused in a shaft portion of an iron core not having a groove portion. In FIG. 38, the axis of abscissa represents a step number, and the axis of ordinate represents standardized loss.

The step number refers to the order of a step where a step portion is located. Specifically, in FIG. 37, a step where step portion 87 is located is a first step, a step where step portion 86 is located is a second step, a step where step portion 85 is located is a third step, a step where step portion 110 is located is a fourth step, and a step where step portion 111 is located is a fifth step. Although the shell-type transformer of the comparative example is provided with five steps on each main surface 44 side of shaft portion 43 of iron core 84, the simulation analysis analyzed up to eight steps. The standardized loss refers to heat generation loss in each step indicated by a relative value when heat generation loss in the first step is set as 1.

As shown in FIG. 38, the standardized loss is lowered with an increase in the step number. In other words, heat generation loss is lowered with increasing distance from main surface 44. The heat generation loss is considered to be caused by eddy current loss. Although loss in a stacked steel plate also includes hysteresis loss, when a magnetic field is vertically applied to a magnetic plate, eddy current loss accounts for an extremely high percentage.

As shown in FIG. 24, a vertical magnetic field is linearly attenuated with respect to a depth from a main surface. Since eddy current loss is proportional to the square of an applied magnetic field, heat generation loss is exponentially decreased with an increase in the step number. Further, the heat generation loss is lowered with increasing distance from side surface 45 to be away from region 140, within main surface 44.

Accordingly, a magnetic flux due to a leakage magnetic field hardly reaches a position away from main surface 44 and side surface 45, for example, positions in groove portions 124, 125 at the fifth step, of the positions where the groove portions are provided in the shell-type transformer of the comparative example. Therefore, providing groove portions 120 to 125 having the same depth as in the shell-type transformer of the comparative example results in providing groove portions also at a position where a magnetic flux hardly reaches, and thus some groove portions hardly contribute to reduction of heat generation loss.

Since it is necessary to perform costly slit processing on magnetic plates in order to forming a slit constituting a groove portion in the magnetic plates, it is required to form a slit at a position where heat generation loss can be efficiently reduced, and thereby reduce a formation density of slits and reduce processing cost.

Thus, in the shell-type transformer in accordance with Embodiment 6 of the present invention, a formation density of slits constituting groove portions provided in shaft portion 43 of iron core 84 is reduced as a distance from main surface 44 in the stacking direction of the magnetic plates is increased.

Figure 39:
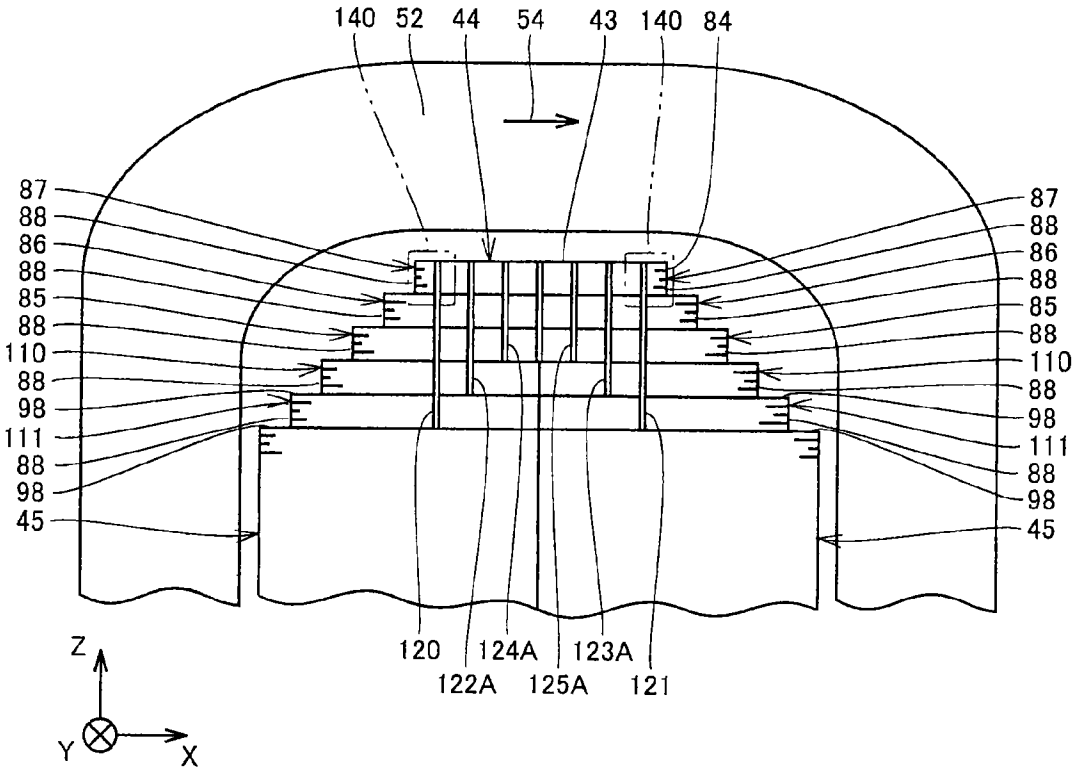
FIG. 39 is a partial cross sectional view of a shell-type transformer in accordance with Embodiment 6 of the present invention.

FIG. 39 is a partial cross sectional view of the shell-type transformer in accordance with Embodiment 6 of the present invention. As shown in FIG. 39, in shaft portion 43 in the shell-type transformer of the present embodiment, groove portions 120, 121 extending from main surface 44 to reach the fifth step are provided to pass through regions 140, as with the shell-type transformer of the comparative example.

However, the groove portions other than groove portions 120, 121 are provided to have depths smaller than that of groove portions 120, 121. In other words, the formation density of the slits constituting the groove portions is reduced as the distance from main surface 44 on a side close to the slits in the stacking direction of the magnetic plates is increased.

Specifically, six groove portions 120, 121, 122A, 123A, 124A, 125A are provided from main surface 44 to the third step. Four groove portions 120, 121, 122A, 123A are provided from the third step to the fourth step. Two groove portions 120, 121 are provided from the fourth step to the fifth step.

Thus, in the shell-type transformer of the present embodiment, a groove portion is not formed at a position which is away from main surface 44 and is hardly reached by a magnetic flux. As a result, the number of slits to be formed in the magnetic plates can be reduced, and manufacturing cost of the shell-type transformer can be reduced.

Although the present embodiment has described a shell-type transformer having a substantially rectangular coil, the present invention is applicable to a shell-type transformer, a core-type transformer, or a reactor having a circular coil.

Hereinafter, a shell-type transformer in accordance with Embodiment 7 of the present invention will be described with reference to the drawings.

<Embodiment 7>

In the shell-type transformer of the present embodiment, the formation density of the slits in the shell-type transformer of Embodiment 6 is further limited.

Generally, an iron core of a transformer is used while being cooled by a cooling oil. The cooling oil flows in contact with a surface of the iron core. Thus, a shaft portion of the iron core is easily cooled in the vicinity of a main surface, and is less likely to be cooled at a position away from the main surface and closer to the inside of the shaft portion. Therefore, preferably, a heat generation density of the iron core is high in the vicinity of the main surface where it is easily cooled, and is low at the inside of the shaft portion where it is less likely to be cooled.

In the present embodiment, a heat generation density of an iron core is set in the preferable state described above by adjusting the formation density of the slits formed in the magnetic plates constituting the iron core. Hereinafter, a method for determining the formation density of the slits will be described.

Figure 40:
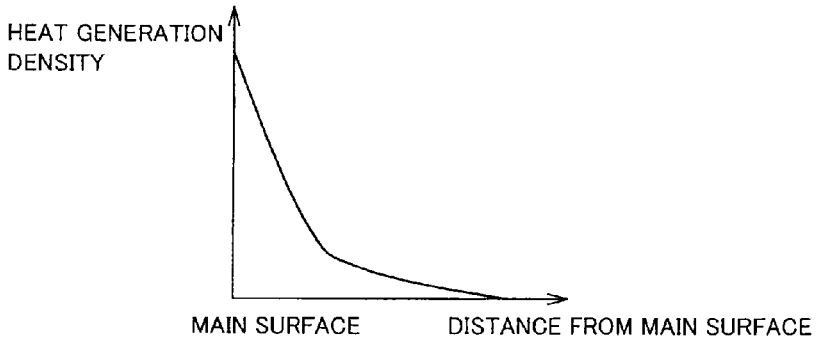
FIG. 40 is a view showing the relation between a heat generation density of an iron core and a distance from a main surface when a vertical magnetic field is applied to the iron core not having slits formed therein.

FIG. 40 is a view showing the relation between a heat generation density of an iron core and a distance from a main surface when a vertical magnetic field is applied to the iron core not having slits formed therein. In FIG. 40, the axis of ordinate represents the heat generation density of the iron core, and the axis of abscissa represents the distance from the main surface.

Figure 41:
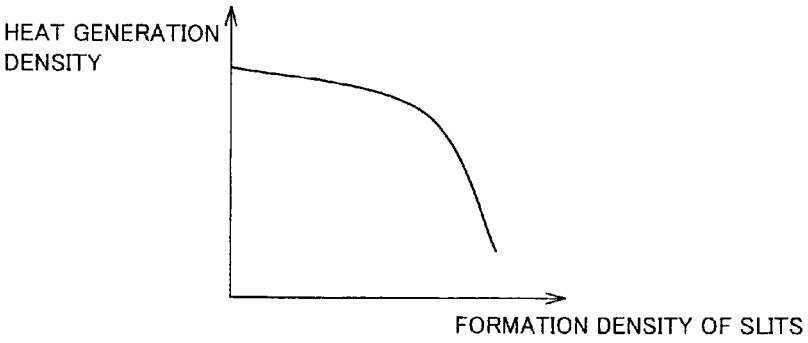
FIG. 41 is a view showing the relation between a heat generation density of an iron core and a formation density of slits.
Figure 42:
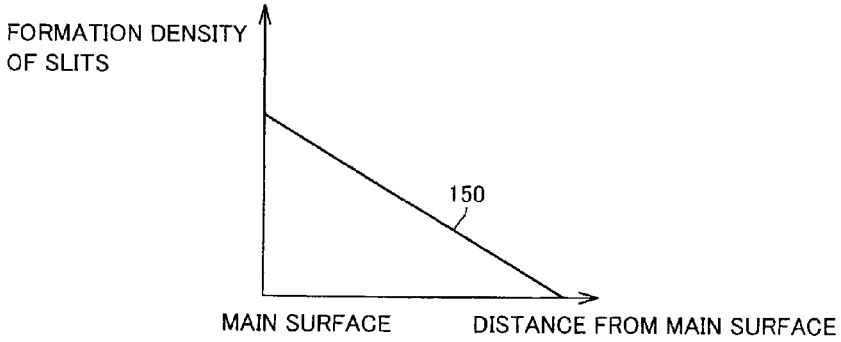
FIG. 42 is a view showing a state where the formation density of the slits is linearly reduced as a distance from a main surface is increased.

FIG. 41 is a view showing the relation between a heat generation density of an iron core and a formation density of slits. In FIG. 41, the axis of ordinate represents the heat generation density of the iron core, and the axis of abscissa represents the formation density of the slits. FIG. 42 is a view showing a state where the formation density of the slits is linearly reduced as a distance from a main surface is increased. In FIG. 42, the axis of ordinate represents the formation density of the slits, and the axis of abscissa represents the distance from the main surface.

Figure 43:
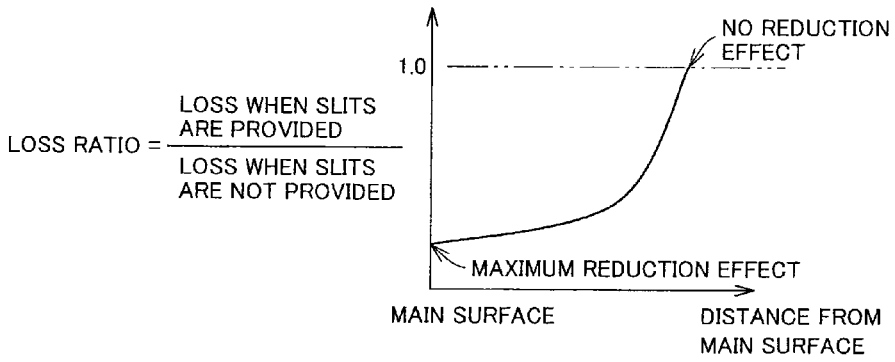
FIG. 43 is a view showing the relation between a loss ratio and the distance from the main surface.

FIG. 43 is a view showing the relation between a loss ratio and the distance from the main surface. In FIG. 43, the axis of ordinate represents the loss ratio, and the axis of abscissa represents the distance from the main surface. It is to be noted that the loss ratio refers to a ratio of a loss amount in an iron core when it is provided with slits to a loss amount in the iron core when it is not provided with slits. Namely, a lower loss ratio indicates a higher effect of reducing loss by slits.

Figure 44:
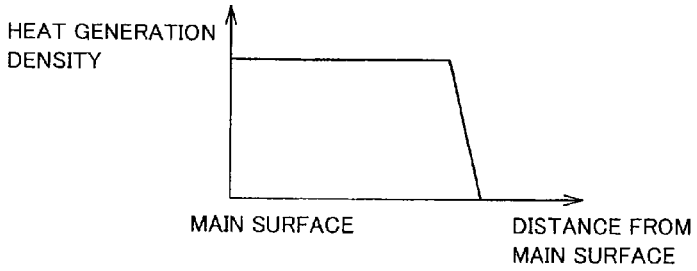
FIG. 44 is a view showing the relation between the heat generation density of the iron core and the distance from the main surface when the formation density of the slits is linearly reduced as shown in FIG. 42.

FIG. 44 is a view showing the relation between the heat generation density of the iron core and the distance from the main surface when the formation density of the slits is linearly reduced as shown in FIG. 42. In FIG. 44, the axis of ordinate represents the heat generation density of the iron core, and the axis of abscissa represents the distance from the main surface.

As shown in FIG. 40, the heat generation density of the iron core is reduced as the distance from the main surface is increased. The heat generation density is proportional to the square of an intensity of a vertical magnetic field. The intensity of the vertical magnetic field linearly varies in accordance with the distance from the main surface. Therefore, the heat generation density is reduced in inverse proportion to the square of the distance from the main surface.

As shown in FIG. 41, the heat generation density of the iron core is reduced as the formation density of the slits is increased. This is because formation of the slits can divide the magnetic plates and reduce eddy current loss, as described above.

As shown in FIG. 42, the formation density of the slits is linearly reduced as the distance from the main surface is increased. The linear shape on this occasion satisfies the relation of being on a line segment 150, and the formation density of the slits is reduced at a constant rate as the distance from the main surface is increased. It is to be noted that, in the shell-type transformer illustrated in Embodiment 6, the formation density of the slits is constant without being reduced up to a predetermined distance from the main surface, and the formation density of the slits starts to be reduced at a position beyond the predetermined distance.

By changing the formation density of the slits to satisfy the relation of being on line segment 150 shown in FIG. 42, the loss ratio is minimum on the main surface, and the loss ratio is increased and finally reaches 1.0 as the distance from the main surface is increased, as shown in FIG. 43. Specifically, the loss ratio is increased in proportion to the square of the distance from the main surface. This indicates that, in the main surface of the iron core, multiple slits are formed and thereby eddy current loss is reduced, and inside the iron core, no slit is formed and thereby eddy current loss is not reduced at all.

By forming the slits to satisfy the relation of being on line segment 150 shown in FIG. 42, the heat generation density of the iron core is constant up to a predetermined distance from the main surface, and the heat generation density of the iron core is reduced from a position at which the distance from the main surface is longer than the predetermined distance, as shown in FIG. 44.

This is the result of multiplication of the heat generation density shown in FIG. 40 and the loss ratio shown in FIG. 43. Namely, this is the result of multiplication of the heat generation density which is inversely proportional to the square of the distance from the main surface and the loss ratio which is proportional to the square of the distance from the main surface. Distribution of the heat generation density shown in FIG. 44 is acceptable, because there is no portion having a heat generation density higher than that of the main surface, inside the iron core.

Figure 45:
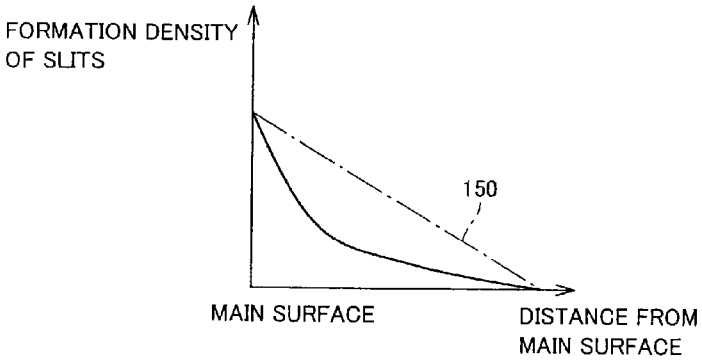
FIG. 45 is a view showing a state where a formation density of slits is reduced as a distance from a main surface is increased in a comparative example.

Hereinafter, a formation density of slits in a shell-type transformer of a comparative example of the present embodiment will be described. FIG. 45 is a view showing a state where a formation density of slits is reduced as a distance from a main surface is increased in the comparative example. In FIG. 45, the axis of ordinate represents the formation density of the slits, and the axis of abscissa represents the distance from the main surface.

Figure 46:
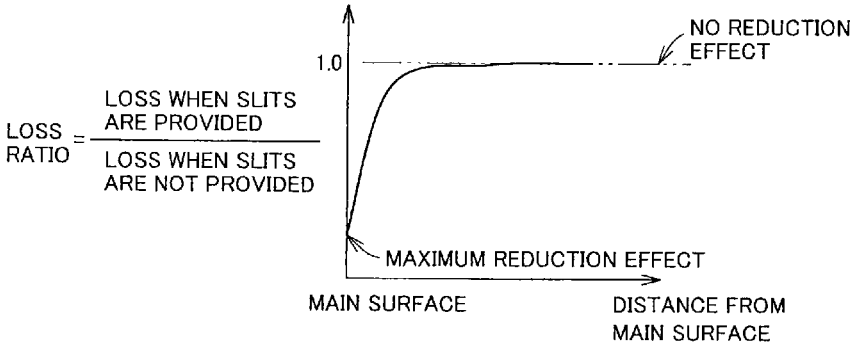
FIG. 46 is a view showing the relation between a loss ratio and the distance from the main surface in the comparative example.
Figure 47:
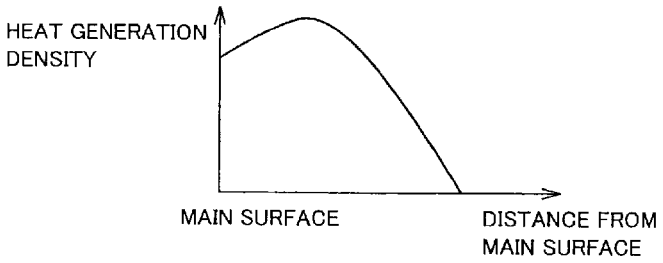
FIG. 47 is a view showing the relation between a heat generation density of an iron core and the distance from the main surface when the formation density of the slits is reduced as shown in FIG. 45.

FIG. 46 is a view showing the relation between a loss ratio and the distance from the main surface in the comparative example. In FIG. 46, the axis of ordinate represents the loss ratio, and the axis of abscissa represents the distance from the main surface. FIG. 47 is a view showing the relation between a heat generation density of an iron core and the distance from the main surface when the formation density of the slits is reduced as shown in FIG. 45. In FIG. 47, the axis of ordinate represents the heat generation density of the iron core, and the axis of abscissa represents the distance from the main surface.

As shown in FIG. 45, in the shell-type transformer of the comparative example, the formation density of the slits is reduced as the distance from the main surface is increased, more abruptly than line segment 150 shown in FIG. 42. In such a case, the loss ratio is abruptly increased and approaches 1.0 as the distance from the main surface is increased, as shown in FIG. 46.

By reducing the formation density of the slits as shown in FIG. 45, a portion having a heat generation density higher than that of the main surface is generated inside the iron core, as shown in FIG. 47. In this case, the inside of the iron core has a high temperature and leads to a defect such as deterioration of the cooling oil, which is not preferable.

Figure 48:
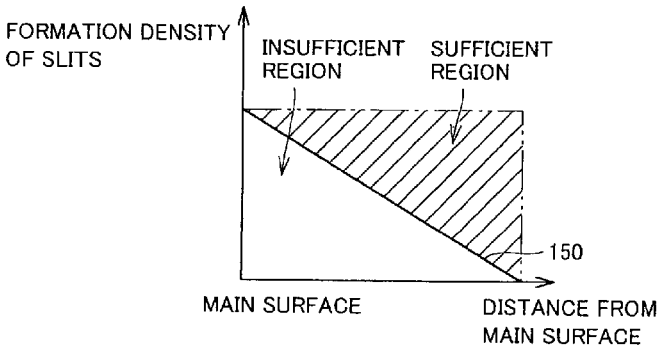
FIG. 48 is a view showing a preferable region of the formation density of the slits.

FIG. 48 is a view showing a preferable region of the formation density of the slits. In FIG. 48, the axis of ordinate represents the formation density of the slits, and the axis of abscissa represents the distance from the main surface. In the shell-type transformer of the present embodiment, as shown in FIG. 48, the formation density of the slits is reduced to be within a range of a sufficient region surrounded by line segment 150 and two chain double-dashed lines.

The sufficient region refers to a region to the upper right of line segment 150 shown in FIG. 42 and in which the formation density of the slits and the distance from the main surface are not more than maximum values on line segment 150. It is to be noted that a region to the lower left of line segment 150 is an insufficient region in which slits are provided insufficiently. If slits are provided such that the formation density of the slits is within the range of the insufficient region, a portion having a heat generation density higher than that of the main surface is generated inside the iron core, as in the shell-type transformer of the comparative example.

If the formation density of the slits is reduced to be within the range of a region to the right of or above the sufficient region, it means that extra slits are provided, which hinders reduction of processing cost and thus is not preferable.

In the present embodiment, generation of a portion having a heat generation density higher than that of the main surface inside the iron core, as in the shell-type transformer of the comparative example, can be prevented by reducing the formation density of the slits as the distance from the main surface is increased, to be within the range of the sufficient region.

In other words, in the shell-type transformer of the present embodiment, the slits are provided such that a heat generation density of heat generated by a magnetic flux passing through the iron core in the stacking direction of the magnetic plates is reduced as the distance from the main surface on the side close to the slits in the stacking direction of the magnetic plates is increased.

It is to be noted that, although the present embodiment has described a shell-type transformer, the present invention is applicable to a core-type transformer or a reactor.

Hereinafter, one exemplary configuration of a reactor will be described.

Figure 49:
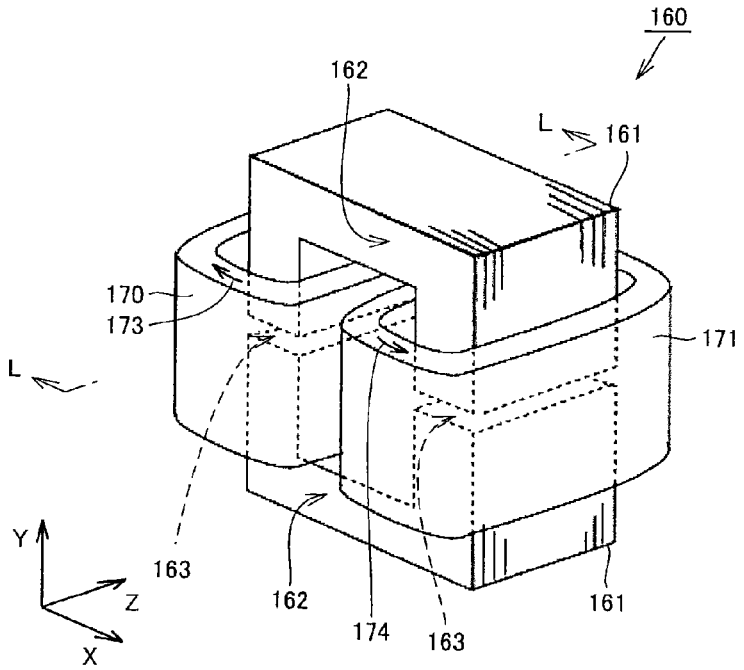
FIG. 49 is a perspective view showing a configuration of a reactor.

FIG. 49 is a perspective view showing a configuration of a reactor. As shown in FIG. 49, a reactor has a configuration similar to that of a core-type transformer. While a core-type transformer includes a high-voltage coil and a low-voltage coil, a reactor includes one type of coil.

As shown in FIG. 49, a reactor 160 includes two iron cores 162 each made of a plurality of magnetic plates 161 stacked in the Z direction as one direction. These two iron cores 162 are arranged in a direction perpendicular to the stacking direction of the plurality of magnetic plates 161 (the Y direction) with a predetermined interval therebetween, and thereby gaps 163 are formed. Reactor 160 includes two coils 170, 171 wound around iron cores 162 to surround gaps 163.

In reactor 160, a current is passed in coil 170 in a direction indicated by an arrow 173 and a current is passed in coil 171 in a direction indicated by an arrow 174 to generate a main magnetic flux circulating through two iron cores 162.

Figure 50:
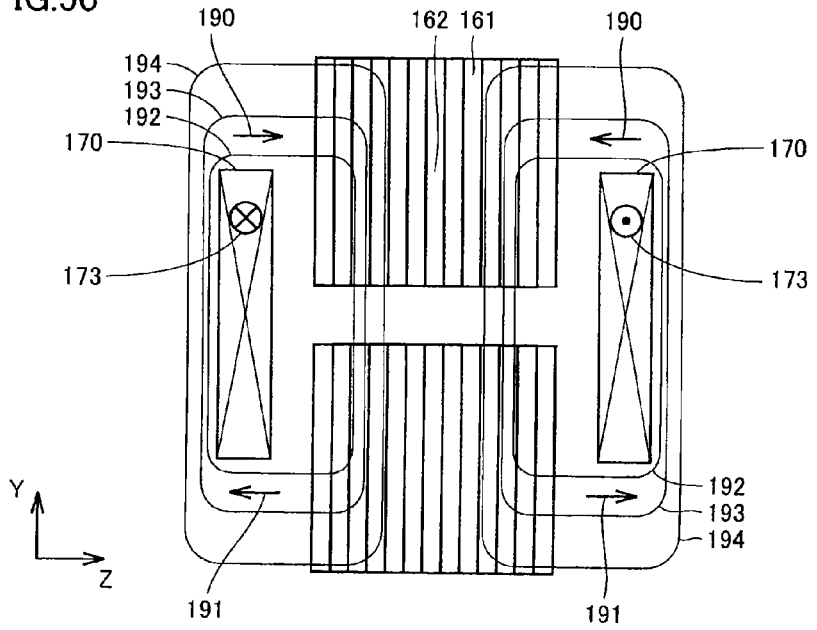
FIG. 50 is a view seen from the direction of arrows in a line L-L in FIG. 49.

FIG. 50 is a view seen from the direction of arrows in a line L-L in FIG. 49. As shown in FIG. 50, on an upper end side of coil 170, leakage magnetic fields 192, 193, 194 are generated in directions indicated by arrows 190. Thus, magnetic fluxes of leakage magnetic fields 192, 193, 194 enter magnetic plates 161 of iron core 162 in a direction perpendicular to magnetic plates 161. Since eddy currents generated by entry of the magnetic fluxes of leakage magnetic fields 192, 193, 194 are generated in a surface direction of magnetic plates 161, influence of eddy current loss is considerably exhibited.

Further, on a lower end side of coil 170, leakage magnetic fields 192, 193, 194 are generated in directions indicated by arrows 191. Thus, the magnetic fluxes of leakage magnetic fields 192, 193, 194 exit from magnetic plates 161 of iron core 162 in the direction perpendicular to magnetic plates 161. Since eddy currents generated by exit of the magnetic fluxes of leakage magnetic fields 192, 193, 194 are generated in the surface direction of magnetic plates 161, influence of eddy current loss is considerably exhibited.

Also in reactor 160, a vertical magnetic field applied to magnetic plates 161 is linearly attenuated with respect to a depth from a main surface, as shown in FIG. 24. Therefore, the present invention is applicable to a reactor, as with the shell-type transformer of the present embodiment.

Hereinafter, a shell-type transformer in accordance with Embodiment 8 of the present invention will be described with reference to the drawings.

<Embodiment 8>

Since the present embodiment is different from Embodiment 6 only in the configuration of groove portions, the description of other configurations will not be repeated.

Figure 51:
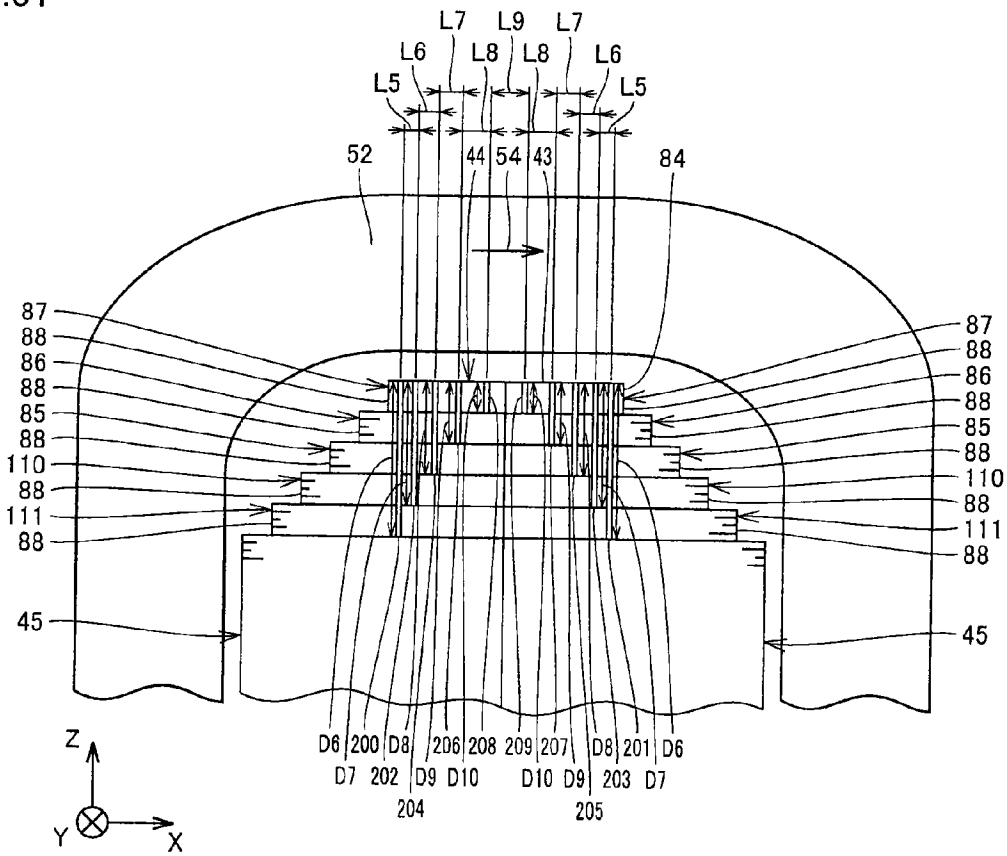
FIG. 51 is a partial cross sectional view of a shell-type transformer in accordance with Embodiment 8 of the present invention.

FIG. 51 is a partial cross sectional view of a shell-type transformer in accordance with Embodiment 8 of the present invention. As described above, magnetic fluxes entering the magnetic plates in the vertical direction are most concentrated at a position of each end portion close to side surface 45 in main surface 44. Therefore, eddy current loss can be efficiently reduced by densely forming slits at the position of each end portion.

As shown in FIG. 51, a groove portion 200 is formed at a position of an end portion close to left side surface 45 within main surface 44. A groove portion 202 is formed adjacent to groove portion 200 with an interval $L_5$ therebetween. A groove portion 204 is formed adjacent to groove portion 202 with an interval $L_6$ therebetween. A groove portion 206 is formed adjacent to groove portion 204 with an interval $L_7$ therebetween. A groove portion 208 is formed adjacent to groove portion 206 with an interval $L_8$ therebetween.

Similarly, a groove portion 201 is formed at a position of an end portion close to right side surface 45 within main surface 44. A groove portion 203 is formed adjacent to groove portion 201 with interval $L_5$ therebetween. A groove portion 205 is formed adjacent to groove portion 203 with interval $L_6$ therebetween. A groove portion 207 is formed adjacent to groove portion 205 with interval $L_7$ therebetween. A groove portion 209 is formed adjacent to groove portion 207 with interval $L_8$ therebetween. An interval $L_9$ is provided between groove portion 208 and groove portion 209.

Groove portions 200 to 209 are formed such that the intervals between the groove portions are set as $L_9>L_8>L_7>L_6>L_5$. Namely, a formation density of slits constituting the groove portions is reduced as a minimum distance from side surface 45 within main surface 44 is increased.

As described above, a vertical magnetic field is reduced as the distance from main surface 44 is increased. Therefore, in the present embodiment, a groove portion is not formed at a position which is away from main surface 44 and is hardly reached by a magnetic flux.

Specifically, groove portions 200 and 201 are formed to have a depth $D_6$, groove portions 202 and 203 are formed to have a depth $D_7$, groove portions 204 and 205 are formed to have a depth $D_8$, groove portions 206 and 207 are formed to have a depth $D_9$, and groove portions 208 and 209 are formed to have a depth $D_{10}$. Groove portions 200 to 209 are formed to have depths set as $D_6>D_7>D_8>D_9>D_{10}$. Namely, the formation density of the slits constituting the groove portions is reduced as the distance from main surface 44 on a side close to the slits in the stacking direction of the magnetic plates is increased.

By forming the slits as described above, eddy current loss can be efficiently reduced, and the number of slits to be formed in the magnetic plates can be reduced to achieve reduction in the manufacturing cost of the shell-type transformer. Although the present embodiment has described a shell-type transformer, the present invention is applicable to a core-type transformer or a reactor.

It is to be noted that the reference examples and the embodiments disclosed herein are illustrative in every respect and do not serve as the basis for restrictive interpretation. Therefore, the technical scope of the present invention is not construed based on only the reference examples and the embodiments described above, but is defined based on the description in the scope of the claims. Further, the technical scope of the present invention includes any modifications within the scope and meaning equivalent to the scope of the claims.

Reference Signs List

1: core-type transformer, 2, 42, 84, 162: iron core, 3, 43, 95: shaft portion, 4: upper yoke, 5: lower yoke, 6: right yoke, 7: left yoke, 8, 48, 68: slit, 9, 36 to 39, 49, 50, 161: magnetic plate, 10, 44: main surface, 11, 51, 170, 171: coil, 12, 52: high-voltage coil, 13, 53: low-voltage coil, 16, 17, 25, 26, 27, 28, 56, 57: eddy current, 22, 23, 24, 63, 69, 192, 193, 194: leakage magnetic field, 29, 30: magnetic flux density, 33, 81: arc portion, 35, 83: end portion, 40, 46: projection region, 41: shell-type transformer, 45, 94: side surface, 47, 73, 97: surface layer magnetic plate, 60, 70, 77: close region, 74: second layer magnetic plate, 75: third layer magnetic plate, 76: fourth layer magnetic plate, 79, 80: curved line, 82: magnetic flux, 85, 86, 87, 110, 111: step portion, 88: step side surface, 90: saturation portion, 98: step front surface, 99, 100, 101, 102, 103, 120 to 125, 200 to 209: groove portion, 104: step surface layer magnetic plate, 150: line segment, 160: reactor, 163: gap.

The invention claimed is:

1. A static apparatus, comprising:

an iron core which includes a plurality of magnetic plates stacked in one direction and in which a shaft portion having a main surface and a side surface is formed; and a coil wound around said shaft portion, said main surface being opposed to an inner peripheral surface of said coil in a stacking direction of said plurality of magnetic plates, said side surface being opposed to said inner peripheral surface in a direction perpendicular to said stacking direction to connect said main surface, slits extending in an axial direction of said shaft portion being formed in at least a surface layer magnetic plate, from among said plurality of magnetic plates, constituting said main surface, wherein said slits are arranged in parallel within said main surface when viewed in a plan view, and arranged such that an interval between said slits in narrower at an end portion close to said side surface than that at a central portion within said main surface.

* * * * *